US005590872A

United States Patent [19]

Oominami et al.

[11] Patent Number: 5,590,872

[45] Date of Patent: Jan. 7, 1997

[54] SHEET REVERSING APPARATUS FOR A COPYING MACHINE

[75] Inventors: Taiichi Oominami, Chiryu; Toshio Sakata, Toyohashi; Masayoshi Kuroda, Toyokawa; Tomonobu Tamura, Toyokawa; Masami Nakane, Toyokawa; Kazuhiko Nakatsuka, Toyokawa, all of Japan

[73] Assignee: Minolta Co., Ltd., Osaka, Japan

[21] Appl. No.: 412,961

[22] Filed: Mar. 29, 1995

[30] Foreign Application Priority Data

| | | | |
|---|---|---|---|
| Mar. 31, 1994 | [JP] | Japan | 6-063552 |
| Jul. 8, 1994 | [JP] | Japan | 6-157538 |
| Mar. 17, 1995 | [JP] | Japan | 7-058786 |

[51] Int. Cl.[6] ..... B65H 43/00

[52] U.S. Cl. ..... 271/176; 271/186; 271/225; 271/902

[58] Field of Search ..... 271/225, 184, 271/185, 186, 176, 265.01, 902

[56] References Cited

U.S. PATENT DOCUMENTS

| | | | |
|---|---|---|---|
| 4,486,012 | 12/1984 | Böck et al. | 271/3 |
| 4,804,175 | 2/1989 | Grandjean | 271/225 |
| 4,963,896 | 10/1990 | Murasaki et al. | 346/134 |
| 5,106,075 | 4/1992 | Wafford et al. | 271/186 |
| 5,133,541 | 7/1992 | Murasaki et al. | 271/176 |
| 5,258,045 | 11/1993 | Yamashita | 271/902 |
| 5,449,164 | 9/1995 | Quesnel et al. | 271/186 |

FOREIGN PATENT DOCUMENTS

| | | | |
|---|---|---|---|
| 0072562 | 5/1982 | Japan | 271/186 |
| 0047751 | 3/1983 | Japan | 271/902 |
| 403192060 | 8/1991 | Japan | 271/186 |
| 403200661 | 9/1991 | Japan | 271/186 |
| 404003770 | 1/1992 | Japan | 271/184 |
| 406183622 | 7/1994 | Japan | 271/186 |

*Primary Examiner*—H. Grant Skaggs
*Attorney, Agent, or Firm*—Brinks Hofer Gilson & Lione

[57] ABSTRACT

A sheet reversing apparatus which has a take-in path, a reversing path which extends from the take-in path in a substantially same direction, a take-out path which extends from a junction of the take-in path and the reversing path in a substantially perpendicular direction to the extending direction of the reversing path. A sheet is fed from the take-in path to the reversing path, and when the trailing edge of the sheet comes out of the take-in path, the sheet is fed back from the reversing path to the take-out path. In an entrance portion of the reversing path, a first reversing roller which is driven to rotate in a feed-back direction toward the take-in path and a second reversing roller which is capable of coming into contact with and moving away from the first reversing roller are provided. The second reversing roller is away from the first reversing roller until the trailing edge of a sheet comes out of the take-in path, and comes into contact with the first reversing roller after the trailing edge comes out of the take-in path.

18 Claims, 27 Drawing Sheets

SHEET REVERSING APPARATUS FOR A COPYING MACHINE

BACKGROUND OF THE INVENTION

1. Field of the Invention

The present invention relates to a sheet reversing apparatus, and more particularly, to a sheet reversing apparatus which is provided in an image forming machine, such as an electrophotographic copying machine, a laser printer or the like, for duplex copying which is copying on both sides of a sheet.

2. Description of Related Art

There is a type of copying machine which has a duplex copying function. In duplex copying, generally, a copy sheet fed from a sheet feeding section receives the first image on the first side and is stored in an intermediate tray temporarily, and the sheet is fed again to receive the second image on the second side.

In order to carry out the duplex copying, a mechanism for reversing the sheet after receiving the first image is necessary. Conventionally, a reversing path is disposed upstream of the intermediate tray, and the sheet which has received the first image is guided from a take-in path into the reversing path without changing the traveling direction. Immediately after the trailing edge of the sheet comes out of the take-in path, a reversing roller provided in the reversing path is reversed, and simultaneously a diverging pawl is switched to open a path toward the intermediate tray.

The reversing mechanism requires means for switching the reversing roller between a normal rotation and a reverse rotation and means for switching the diverging pawl. Further, sensors which detect the position of the sheet are necessary for control of these switching means.

There is a possibility that a sheet is fed into a reversing mechanism askew, and if the sheet is reversed without correcting the skew, trouble such as a sheet jam may occur. However, there have been conventionally no reversing devices which have a function of correcting possible skew of a sheet.

SUMMARY OF THE INVENTION

An object of the present invention is to provide a sheet reversing apparatus wherein a reversing roller provided in a reversing path needs to be rotated in only one direction, that is, the rotating direction of the reversing roller is not required to be switched.

Another object of the present invention is to provide a sheet reversing apparatus which requires neither a diverting pawl for opening a path from a reversing path to an intermediate tray nor sensors for detecting the position of a sheet.

Another object of the present invention is to provide a sheet reversing apparatus which has a function of correcting possible skew of a sheet.

In order to attain the objects, a sheet reversing apparatus according to the present invention comprises: a take-in path, a reversing path and a take-out path which are joined into the shape of a T; a transport roller which feeds a sheet from the take-in path to the reversing path and from the reversing path to the take-out path; a first reversing roller which is disposed in an entrance portion of the reversing path and is driven to rotate in a feed-back direction toward the take-in path at all times; a second reversing roller which is capable of coming into contact with and moving away from the first reversing roller, the second reversing roller being freely rotatable; and a lever which keeps the second reversing roller away from the first reversing roller until a trailing edge of a sheet comes out of the take-in path and makes the second reversing roller come into contact with the first reversing roller when the trailing edge of the sheet comes out of the take-in path.

In the structure, a sheet which has traveled through the take-in path is fed to the reversing path by the transport roller, and in this moment, the second reversing roller is away from the first reversing roller. Thereby, although the first reversing roller rotates in the feed-back direction, the sheet passes between the first reversing roller and the second reversing roller and comes into the reversing path without obstruction of the force of the first reversing roller. When the trailing edge of the sheet comes out of the take-in path, the second reversing roller comes into contact with the first reversing roller. Thereby, the sheet is provided with the force of the first reversing roller and is fed back from the reversing path. Thereafter, the sheet is fed to the take-out path by the transport roller with the leading edge trailing, and thus, the sheet is reversed.

Since the first reversing roller is driven to rotate only in the feed-back direction, rotation switching means is not necessary. Besides, the sheet reversing apparatus does not require a pawl for changing the traveling direction of a sheet.

In the sheet reversing apparatus according to the present invention, preferably, the lever is disposed such that one end thereof is usually located in the take-in path and is capable of retreating from the take-in path, and while the end of the lever is located in the take-in path, the lever keeps the second reversing roller in contact with the first reversing roller. When a sheet reaches the end of the lever, the sheet pushes the end of the lever out of the take-in path, and thereby, the lever moves the second reversing roller away from the first reversing roller. With this arrangement, the engagement between the first reversing roller and the second reversing roller can be controlled automatically in synchronization with the travel of a sheet. Therefore, sensors for detecting the position of a sheet are not necessary.

It is preferred that the lever is turned to make the second reversing roller come into contact with the first reversing roller with a slight time lag after the trailing edge of a sheet comes out of the take-in path. By slightly delaying the start of sheet feed-back from the reversing path, bending of the trailing portion of the sheet can be prevented.

Further, in the sheet reversing apparatus, the center of rotation of the second reversing roller is farther inside the reversing path than that of the first reversing roller. With this arrangement, a sheet held between the first reversing roller and the second reversing roller leans toward the opposite side of the take-out path. Thereby, there is no fear that the sheet may bend toward the take-out path, and thus, smooth sheet travel without sheet jamming is guaranteed.

Another sheet reversing apparatus according to the present invention comprises: a take-in path, a reversing path and a take-out path which are joined into the shape of a T; a transport roller which is driven to rotate in one direction; a first pressing roller for transporting a sheet from the take-in path to the reversing path, the first pressing roller being in contact with and driven by the transport roller; a second pressing roller for transporting a sheet from the reversing path to the take-out path, the second pressing roller being in contact with and driven by the transport roller; a paddle roller which is provided coaxially with the transport roller, the paddle roller having a paddle projecting over the circumference of the transport roller; a clutch mechanism which connects the paddle roller with the transport roller to rotate the paddle roller and disconnects the paddle roller from the transport roller to stop the rotation of the paddle roller; a sensor which detects that the trailing edge of a sheet passes between the transport roller and the first pressing roller; and a controller which actuates the clutch mechanism to rotate the paddle roller a specified after the sensor detects the trailing edge of a sheet.

In the structure, a sheet fed in the take-in path is nipped between the transport roller and the first pressing roller and thereby is fed to the reversing path. When the trailing edge of the sheet passes between the transport roller and the first pressing roller, the sheet is released from the transporting force to the reversing path, and the trailing portion of the sheet slips there. Then, the paddle roller is rotated to move the trailing edge of the sheet to the second pressing roller. Thereby, the trailing edge of the sheet is nipped between the transport roller and the second pressing roller, and thereafter, the sheet is fed to the take-out path with the trailing edge leading and upside down.

In short, the trailing edge of a sheet which has passed through the nipping portion of the transport roller and the first pressing roller slips there, and then, the edge is moved toward the take-out path by the paddle roller. While the sheet is slipping, possible skew of the sheet is corrected.

The paddle roller is only rotated at the above-described timing, and there is no fear that the paddle may scratch and/or crease the sheet.

BRIEF DESCRIPTION OF THE DRAWINGS

These and other objects and features of the present invention will be apparent from the following description with reference to the accompanying drawings, in which.

DETAILED DESCRIPTION OF THE PREFERRED EMBODIMENTS

Preferred embodiments of the present invention are described with reference to the accompanying drawings. In the embodiments, the present invention is applied to a sheet reversing unit used for duplex copying in an electrophotographic copying machine.

First Embodiment

General Structure of the Copying Machine

Figure 1:
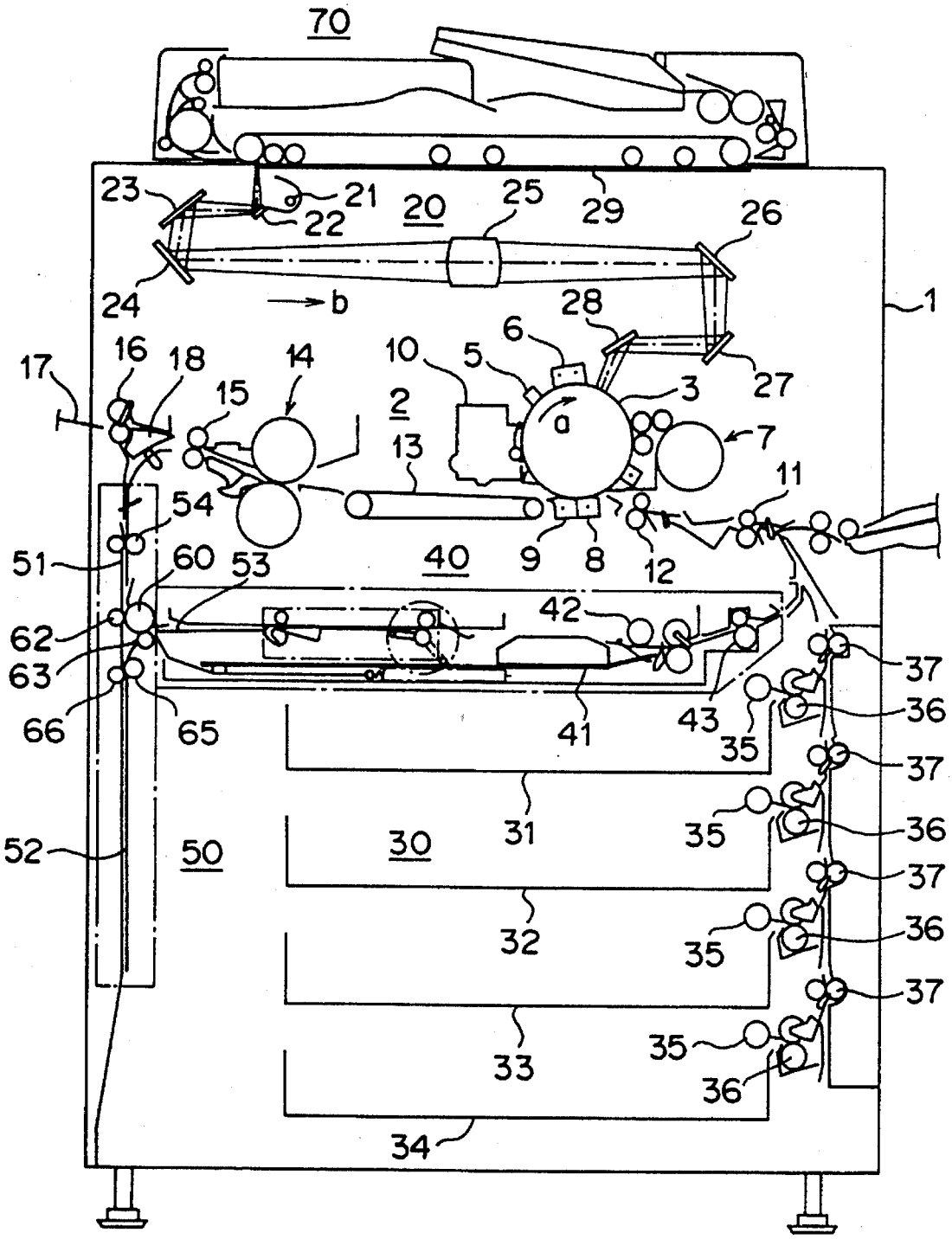
FIG. 1 is an elevational view of copying machine provided with a sheet reversing unit which is a first embodiment of the present invention, showing the internal composition.

Referring to FIG. 1, the general structure of a copying machine is described. The copying machine has, in a body 1, an image forming section 2 in the middle portion, an exposure optical system 20 in the upper portion, a sheet feeding section 30 in the lower portion, a sheet refeeding unit 40 between the image forming section 2 and the sheet feeding section 30, and a sheet reversing unit 50 upstream of the sheet refeeding unit 40. Further, an automatic document feeder (ADF) 70 is provided on the upper surface of the body 1. The ADF 70 is a conventional type, and the detailed description thereof is omitted.

In the image forming section 2, a photosensitive drum 3 which is driven to rotate in a direction of arrow a is disposed in the center. Around the photosensitive drum 3, a residual charge eraser 5, a charger 6, a developing device 7, a transfer charger 8, a sheet separation charger 9 and a residual toner cleaner 10 are disposed in order in the rotating direction a of the photosensitive drum 3. These image forming elements and the image forming process are well known, and the detailed description thereof is omitted.

The optical system 20 comprises an exposure lamp 21, movable mirrors 22, 23 and 24, an imaging lens 25, and fixed mirrors 26, 27 and 28. The lamp 21 and the mirror 22 move together at a speed of v/m (v: circumferential speed of the photosensitive drum 3, m: magnification), and the movable mirrors 23 and 24 move together at a speed of v/2m. The lamp 21 and the mirrors 22, 23 and 24 move in a direction of arrow b. Original documents are set on a platen glass 29 one by one automatically by the ADF 70 or manually by the operator. As the lamp 21 and the mirrors 22, 23 and 24 are moving in the direction of b, the photosensitive drum 3 is exposed according to an original image set on the platen glass 29.

The sheet feeding section 30 has automatic feed cassettes 31 through 34 which contain different sizes of copy sheets. Above each of the cassettes 31 through 34, a pick-up roller 35, a separation roller pair 36 and a feed roller pair 37 are provided. One of the cassettes is selected, and copy sheets are fed out of the selected cassette one by one and are transported upward by the feed roller pair 37.

In the image forming section 2, an intermediate roller 11, a timing roller 12 and a conveyer belt 13 are disposed upstream of a fixing device 14, and an intermediate roller 15 and an ejection roller 16 are disposed downstream of the fixing device 14. A sheet fed from the sheet feeding section 30 is transported by the intermediate roller 11 and stops at the timing roller 12. The sheet is fed to a transfer position by the timing roller 12 in synchronization with an image formed on the photosensitive drum 3. After transfer of the image, the sheet is transported by the conveyer belt 13 to the fixing device 14 where the toner is fused and fixed on the sheet. Then, the sheet is ejected onto a tray 17 through the ejection roller 16.

The refeeding unit 40 is to store sheets with an image on one side (first side) and to feed the sheets again to the transfer position one by one at a specified timing. The refeeding unit 40 comprises an intermediate tray 41, a pick-up roller 42, etc. A sheet fed out of the intermediate tray 41 by the pick-up roller 42 is transported to the timing roller 12 by the intermediate roller 11 and fed to the transfer position to receive another image on the reverse side (second side).

The sheet reversing unit 50 receives a sheet which has received an image on a first side. The sheet is received by a take-in path 51 and is transported to a reversing path 52 by a transport roller 60 and a guide roller 62. Immediately after the trailing edge of the sheet passes through the rollers 60 and 62, reversing rollers 65 and 66 start to feed back the sheet from the reversing path 52. Then, the sheet is fed to the intermediate tray 40 by the transport roller 60 and a guide roller 63 through a take-out path 53. In order to guide sheets to the sheet reversing unit 50, a diverging pawl 18 is disposed immediately before the ejection roller 16. The diverging pawl 18 guides sheets to the sheet reversing unit 50 while being set in the position shown in FIG. 1, and guides sheets to the tray 17 while being set in a position turned slightly clockwise.

Structure and Action of the Sheet Reversing Unit

The structure and action of the sheet reversing unit 50 is described.

Figure 2:
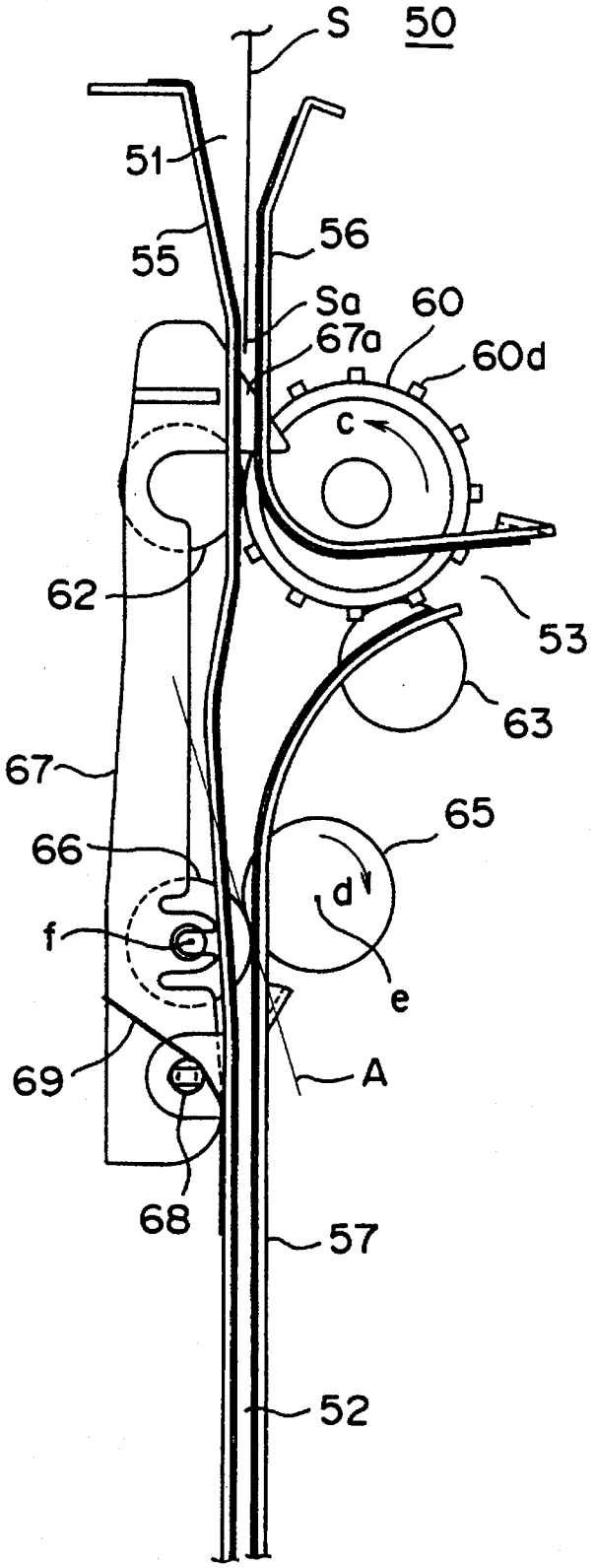
FIGS. 2, 3, 4 and 5 are sectional views of the first sheet reversing unit, explaining the action.

As shown in FIG. 2, the take-in path 51 is formed by the upper half of a guide plate 55 and the upper half of a guide plate 56. The reversing path 52 is formed by the lower half of the guide plate 55 and a guide plate 57. The take-out path 53 is formed by the lower half of the guide plate 56 and the upper end of the guide plate 57.

Figure 8:
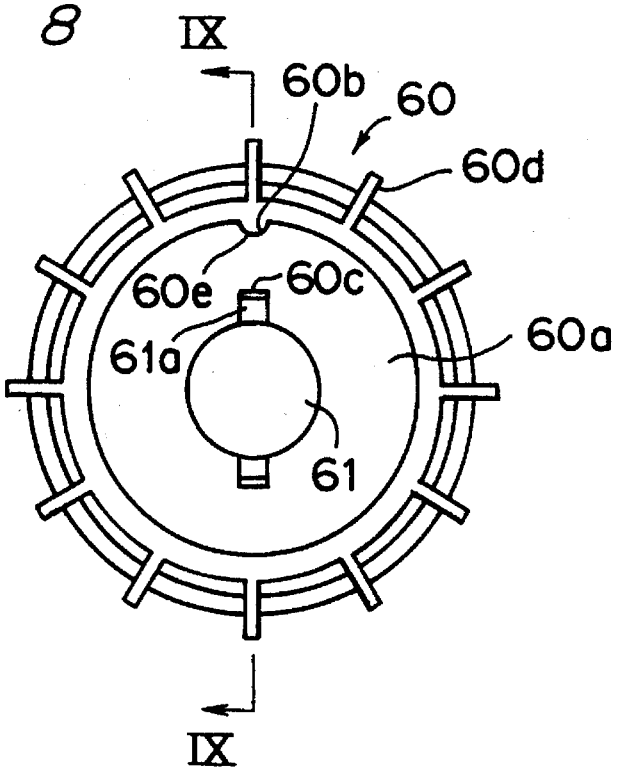
FIG. 8 is a front view of a transport roller provided in the first sheet reversing unit.
Figure 9:
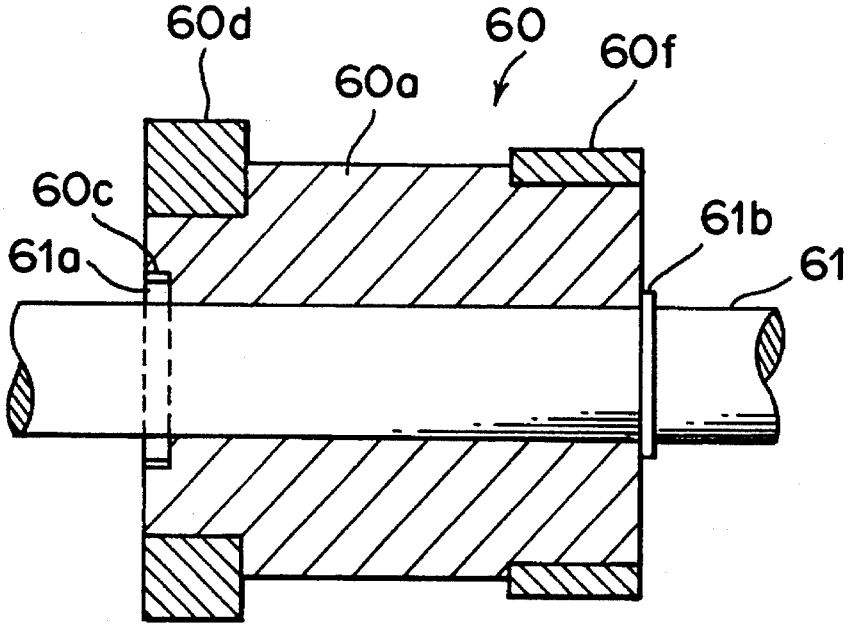
FIG. 9 is a sectional view of the transport roller of FIG. 8, taken along the line IX—IX.

The take-in path 51 and the reversing path 52 are connected to extend straight vertically, and the take-out path 53 diverges in a perpendicular direction to the paths 51 and 52. At the junction of the paths 51, 52 and 53, the transport roller 60 which is rotated in a direction of arrow c is disposed, and the guide rollers 62 and 63 which are pressed against the roller 60 and driven thereby are disposed. The transport roller 60, as shown in FIGS. 8 and 9, has a plurality of wheels, each of which has a paddle ring **60*d* and a ring 60*f* fixed on the circumference of a center roll 60*a*. Wheels of the driven transport rollers 62 and 63 are pressed against the rings 60*f***.

As shown in FIG. 2, at the entrance of the reversing path 52, a first reversing roller 65 and a second reversing roller 66 are disposed. The first reversing roller 65 is driven to rotate in a direction of arrow d, and the second reversing roller 66 is capable of coming into contact with and moving away from the first reversing roller 65. Wheels of the second reversing roller 66 are rotatably fitted in levers 67, and the levers 67 are pivoted on a pin 68 outside the reversing path 52. Each of the levers 67 is urged clockwise by a torsion spring 69. Because of the forces of the respective torsion springs 69, the second reversing roller 66 comes into contact with the first reversing roller 65, and simultaneously, pawls **67*a* at the upper ends of the levers 67 advance in the take-in path 51. The pin 68 supporting the levers 67 is disposed downstream of the second reversing roller 66 with respect to the direction from the take-in path 51 to the reversing path 52. Therefore, when the levers 67 turn clockwise, the second reversing roller 66 comes into contact with the first reversing roller 65, and when the levers 67 turn counterclockwise, the second reversing roller 66 moves away from the first reversing roller 65**.

Now, the action of the sheet reversing unit 50 is described.

Figure 3:
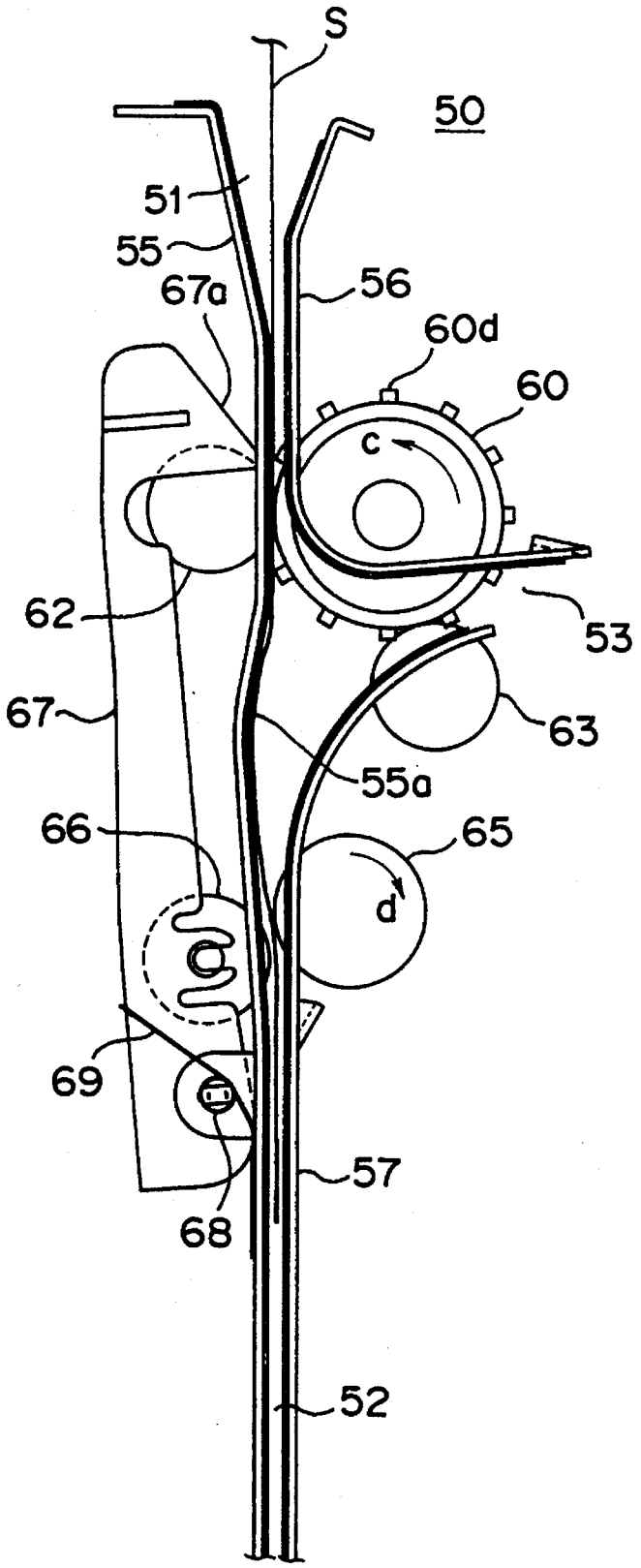

In reversing a sheet, the transport roller 60 is driven to rotate in the direction of arrow c, and the first reversing roller 65 is driven to rotate in the direction of arrow d. A sheet S which has received an image on the first side is guided to the take-in path 51 of the reversing unit 50 by the diverging pawl 18 and is fed downward by the transport roller pair 54. When the leading edge Sa of the sheet S reaches the pawls **67*a* of the levers 67, the levers 67 turn counterclockwise in FIG. 2 on the pin 68, and thereby the pawls 67*a* retreat from the take-in path 51. Then, the sheet S comes to the nipping portion of the transport roller 60 and the guide roller 62 and is fed straight down to the reversing path 52 by the rollers 60 and 62. By the counterclockwise turn of the levers 67, the second reversing roller 66 moves away from the first reversing roller 65 (see FIG. 3), and the sheet S goes downward between the rollers 65 and 66. In this moment, although the first reversing roller 65 is rotating in the direction of d, the sheet S, even if the sheet S has a small specific gravity, goes downward smoothly because there is a space between the rollers 65 and 66**.

Figure 4:
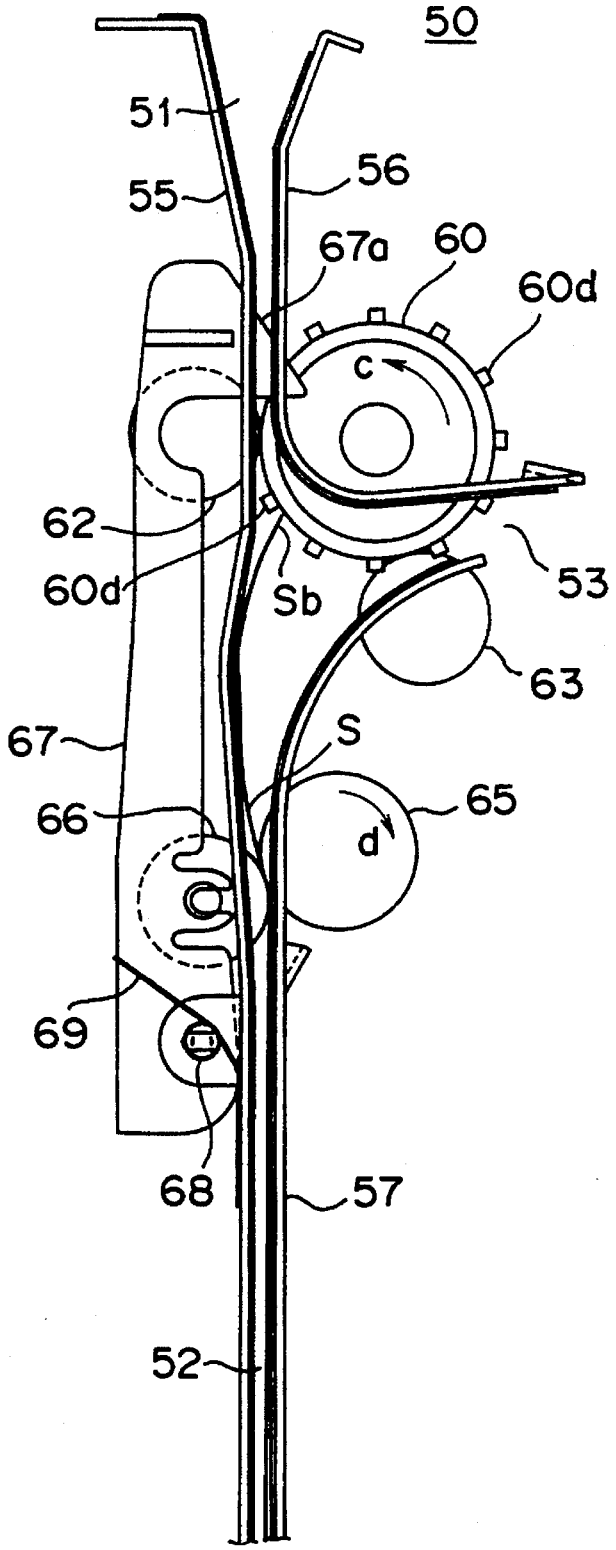
Figure 5:
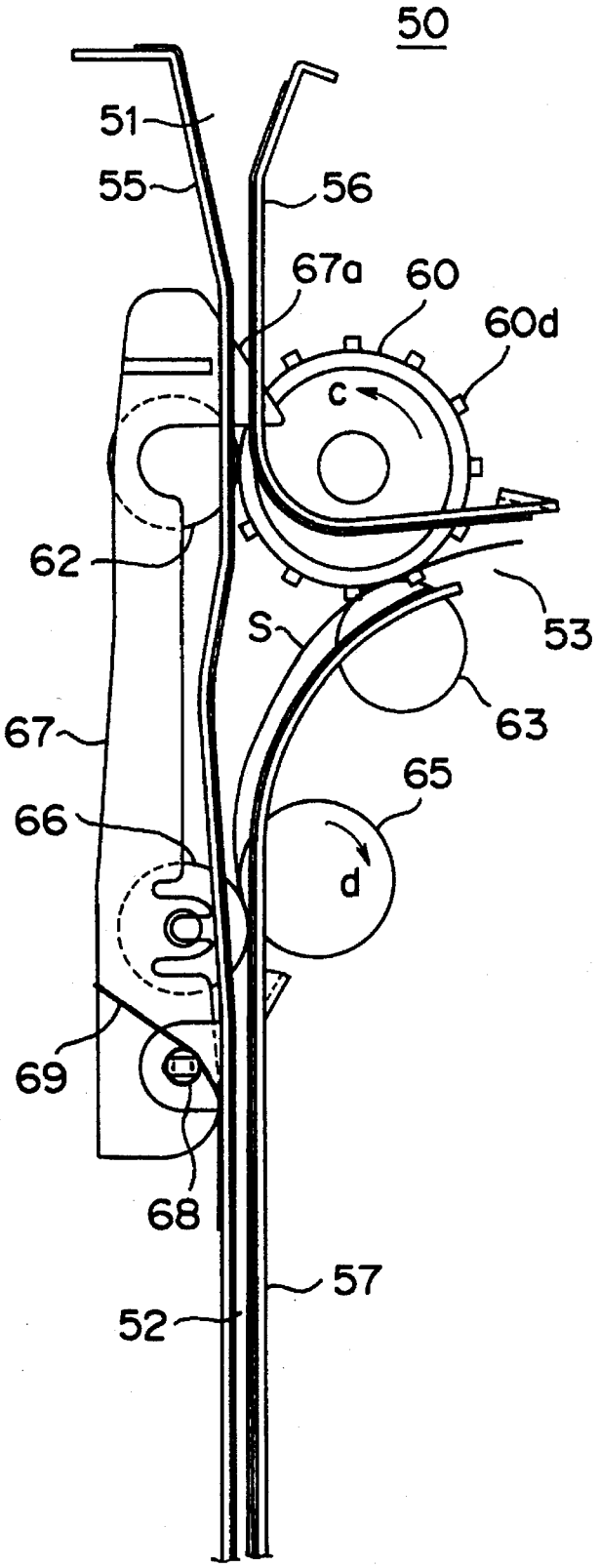

When the trailing edge Sb of the sheet S passes through the pawls **67*a* of the levers 67, that is, passes through the nipping portion of the rollers 60 and 62, the levers 67 turn clockwise by the forces of the torsion springs 69 (see FIG. 4). Accordingly, the pawls 67*a* advance into the take-in path 51, and the second reversing roller 66 comes into contact with the first reversing roller 65. Thereby, the rotating force of the first reversing roller 65 in the direction of arrow d acts on the sheet S, and the sheet S is fed back. In this moment, the edge Sb of the sheet S is caught by the paddle rings 60*d* of the transport roller 60 rotating in the direction of arrow c, and is guided to the nipping portion of the transport roller 60 and the guide roller 63. Once the edge Sb of the sheet S comes into the nipping portion of the rollers 60 and 63, the sheet S travels in the take-out path 53 and is received by the refeeding unit 40 upside down (see FIG. 5**).

In the first embodiment, since the first reversing roller 65 is structured to rotate in the feed-back direction (direction of arrow d) all the time, the driving mechanism of the first reversing roller 65 can be simplified. On the other hand, when a sheet is coming into the reversing path 52, it is necessary to weaken the force of the first reversing roller 65 acting on the sheet to assure downward movement of the sheet. Therefore, in the first embodiment, the levers 67 are provided such that the second reversing roller 66 moves away from the first reversing roller 65 before the sheet comes between the rollers 65 and 66. With this arrangement, a sheet which is coming into the reversing path 52 is not practically influenced by the force of the reversing rollers 65 and 66, and troubles which may be caused by the continuous feed-back rotation of the first reversing roller 65, such as bending, skewing and slipping between the rollers 60 and 62 of the sheet, can be avoided. Additionally, the levers 67 move such that the second reversing roller 66 comes into contact with the first reversing roller 65 when the trailing edge of a sheet comes out of the take-in path 51, and thereby, the sheet starts to be fed back from the reversing path 52 automatically. Accordingly, sheet sensors and a control circuit thereof are not necessary.

It is not always necessary to move the second reversing roller 66 completely off from the first reversing roller 65, and it is sufficient to weaken the pressure of the rollers 65 and 66 against each other to such an extent as not to prevent the movement of the sheet into the reversing path 52.

Each of the torsion springs 69 urging the levers 67 has relatively a small force, and not a big force is necessary to turn each lever 67. Therefore, a sheet coming into the sheet reversing unit 50, even if the sheet has a small specific gravity, can push the pawls 67*a* to turn the levers 67, and there is no fear that the leading edge of the sheet may be damaged or bent.

Further, as can be seen in FIG. 2, the rotation center or axis f of the second reversing roller 66 is disposed lower than the rotation center or axis e of the first reversing roller 65. More specifically, the second reversing roller 66 is disposed farther from the take-out path 53 than the first reversing roller 65, and the rotation center f of the second reversing roller 66 is located downstream of the rotation center e of the first reversing roller 65 with respect to the direction from the take-in path 52 to the reversing path 53. Thereby, the contact point between the rollers 65 and 66 has a tangential line A which is on a slant to the guide plate 55, that is, to the opposite side of the take-out path 53. Accordingly, while the sheet S is held between the rollers 65 and 66 (see FIG. 3), the portion of the sheet S above the rollers 65 and 66 leans against the guide plate 55. There is a possibility that the sheet curves between the transport roller 60 and the first reversing roller 65, and if the sheet S curves toward the take-out path 53, the sheet S may be crumpled by the transport roller 60 and the guide roller 63, thereby causing a sheet jam. However, in the first embodiment, since the tangential line A on the contact point between the reversing rollers 65 and 66 is on a slant to the guide plate 55, such troubles can be avoided. Further, the guide plate 55 has an outwardly curved portion 55*a* at a place which is opposite the take-out path 53. With this arrangement, the sheet S is prevented from curving toward the take-out path 53 more effectively.

The arrangements to keep the sheet S away from the take-out path 53, conversely, helps a stable movement of the edge Sb of the sheet S to the nipping portion of the transport roller 60 and the guide roller 63 when the sheet S is fed back by the reversing rollers 65 and 66.

Figure 6:
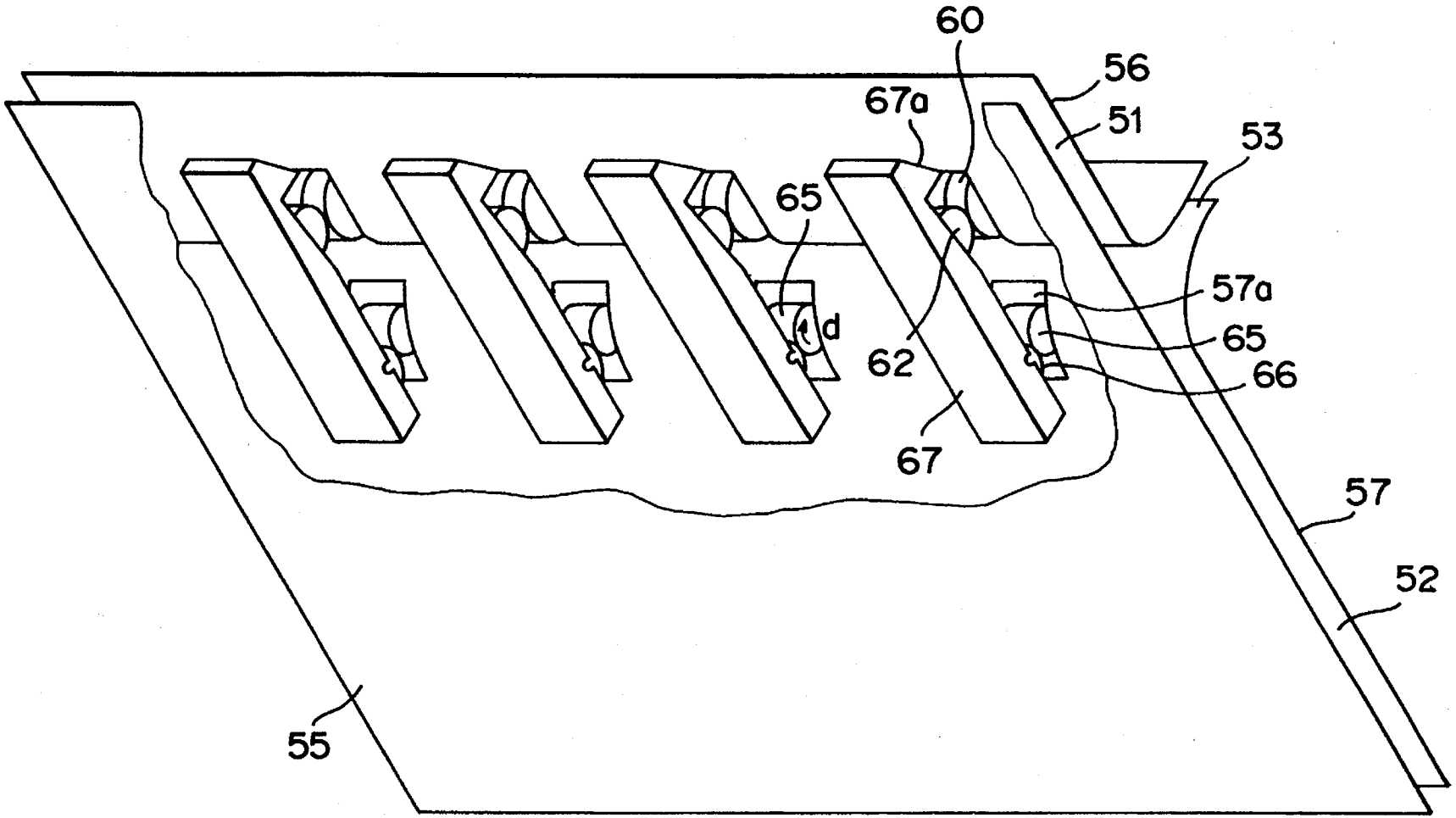
FIG. 6 is a perspective view of the main part of the first sheet reversing unit.
Figure 10:
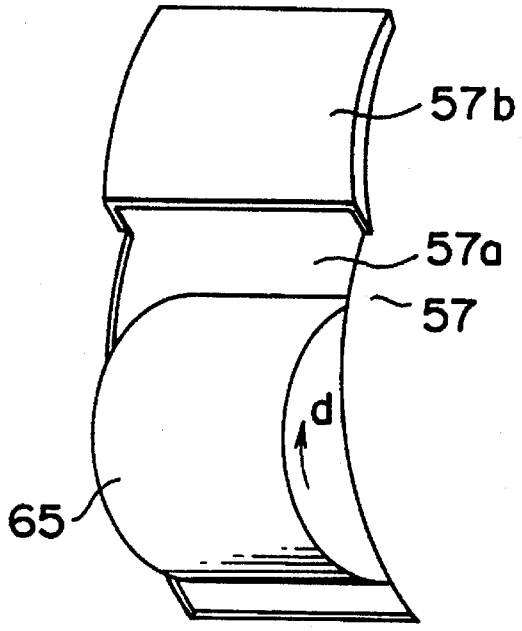
FIG. 10 is a perspective view of an example of a sheet guide to be provided in the first sheet reversing unit.
Figure 11:
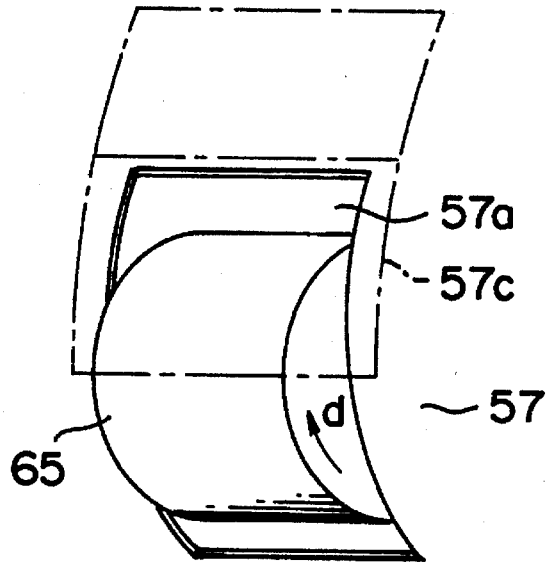
FIG. 11 is a perspective view of another example of a sheet guide to be provided in the first sheet reversing unit.

Wheels of the first reversing roller 65 are fitted to the guide plate 57, and as shown in FIG. 6, advance in the reversing path 52 through windows 57*a* made in the guide plate 57. There is a possibility that when a sheet is guided into the reversing path 52, the leading edge of the sheet may be stuck between the wheels of the first reversing roller 65 rotating in the direction of arrow d and the windows 57*a*. In order to prevent this trouble, it is possible to provide projections 57*b* above the windows 57*a* as shown in FIG. 10. Another preventive measure is to cover the upper portions of the respective windows 57*a* with slippery flexible films 57*c* as shown in FIG. 11. The films 57*c* also prevent skew of a sheet when the sheet is fed back from the reversing path 52.

Referring to FIGS. 8 and 9, the transport roller 60 is described. The transport roller 60 has a plurality of wheels around a shaft 61, and each wheel has a center roll 60*a* and a paddle ring 60*d* which has a plurality of elastic paddles standing on the outer surface. The paddle rings 60*d* must have the same phase with respect to the paddles. For this purpose, each paddle ring 60*d* has a projection 60*e* on the inner surface, and on the circumference of each center roll 60*a*, a recess 60*b* which engages with the projection 60*e* is made. Further, grooves 60*c* are made on an end surface of the center roll 60*a*, and both ends of a pin 61*a* which pierces through the shaft 61 engages with the grooves 60*c*. At the other end surface of the center roll 60*a*, an E ring 61*b* is fitted to the shaft 61. Thus, each wheel is positioned on the shaft 61 by the engagement of the grooves 60*c* and the pin 61*a* and by the E ring 61*b*.

In this way, the paddle rings 60*d* are set on the respective center rolls 60*a* to have the same phase, and the transport roller 60 can certainly guide a sheet fed back from the reversing path 52 to the take-out path 53. Since the paddle rings 60*d* are elastic, although the paddles of the paddle rings 60*d* cross the nipping portion of the rollers 60 and 62 and the nipping portion of the rollers 60 and 63, this will neither prevent a sheet from entering these nipping portion nor damage the sheet.

Figure 7:
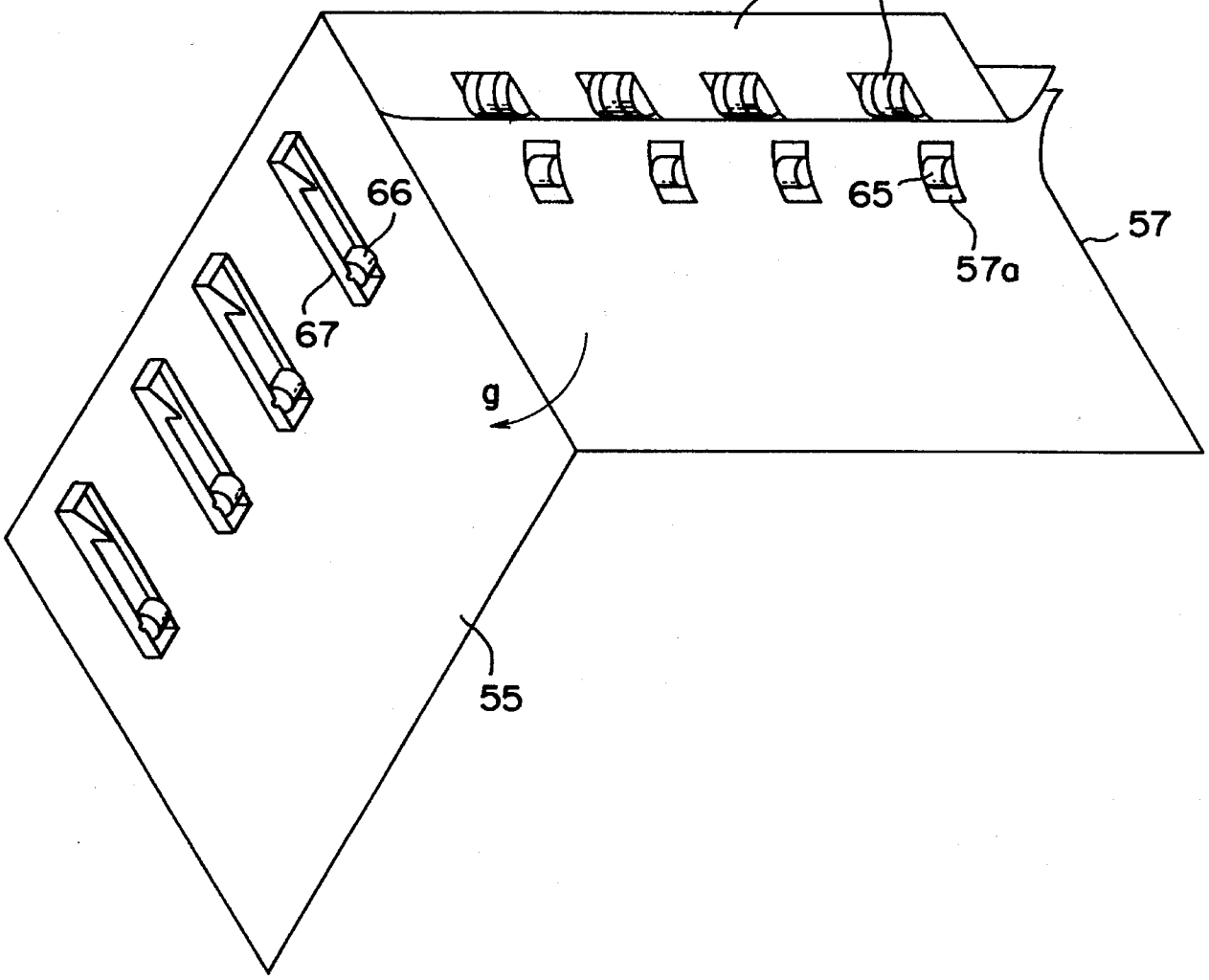
FIG. 7 is a perspective view of the first sheet reversing unit which is in a state that a guide plate is open.

As shown in FIG. 7, the levers 67, the wheels of the second reversing rollers 66 and the wheels of transport rollers 62 (not shown in FIG. 7) are fitted to the guide plate 55, and the guide plate 55 can pivot outward (in a direction of arrow g) on the rear side. This facilitates maintenance of the reversing unit 50 and management of a sheet jam therein.

Second Embodiment

As described in connection with the first embodiment, when the trailing edge Sb of a sheet S passes through the nipping portion of the transport roller 60 and the guide roller 62 (see FIG. 4), the levers 67 turn clockwise back in the home position to make the second reversing roller 66 come into contact with the first reversing roller 65, and thereby, the sheet S starts to be fed back from the reversing path 52. In this moment, if the trailing portion of the sheet S curls toward the levers 67, the curling portion may bend, and the sheet S may be crumpled by the rollers 60 and 63. This trouble happens because the returning timing of the levers 67 is too early especially for a sheet curling at the trailing portion.

Figure 12:
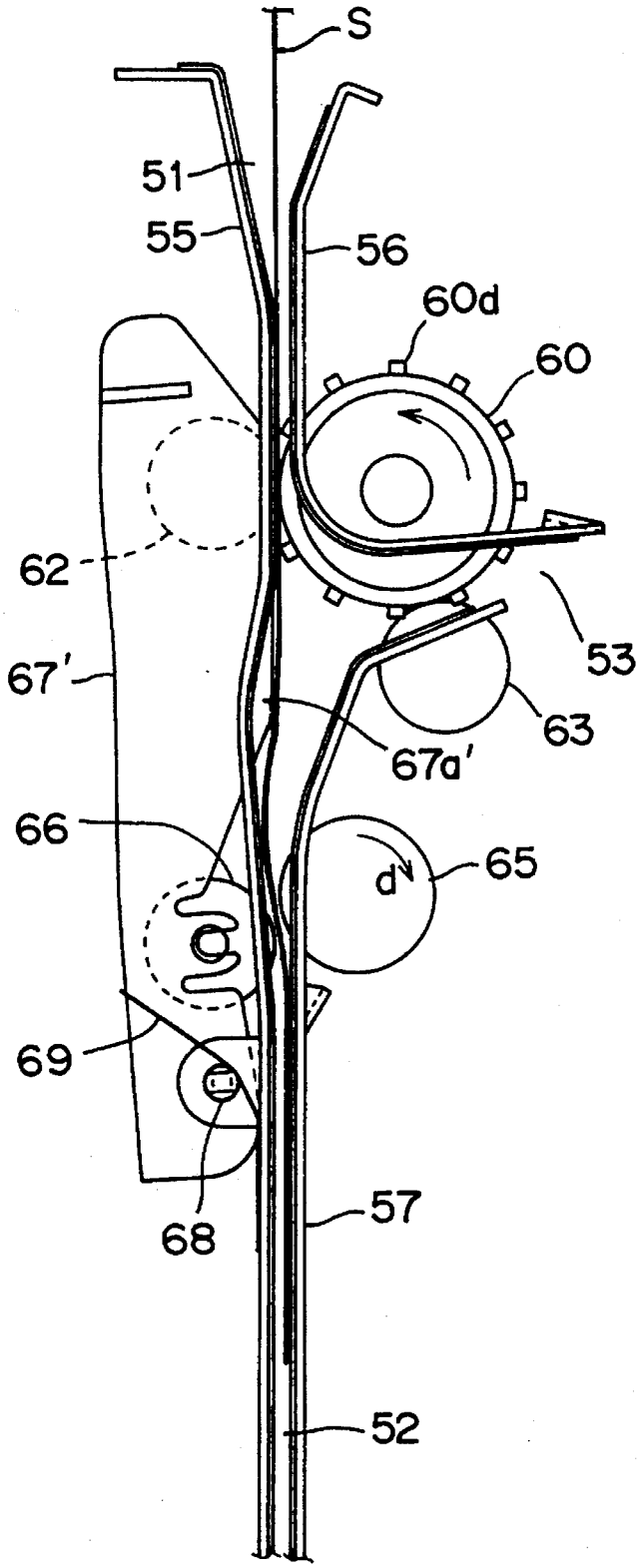
FIGS. 12 and 13 are sectional views of a sheet reversing unit which is a second embodiment of the present invention, explaining the action.
Figure 13:
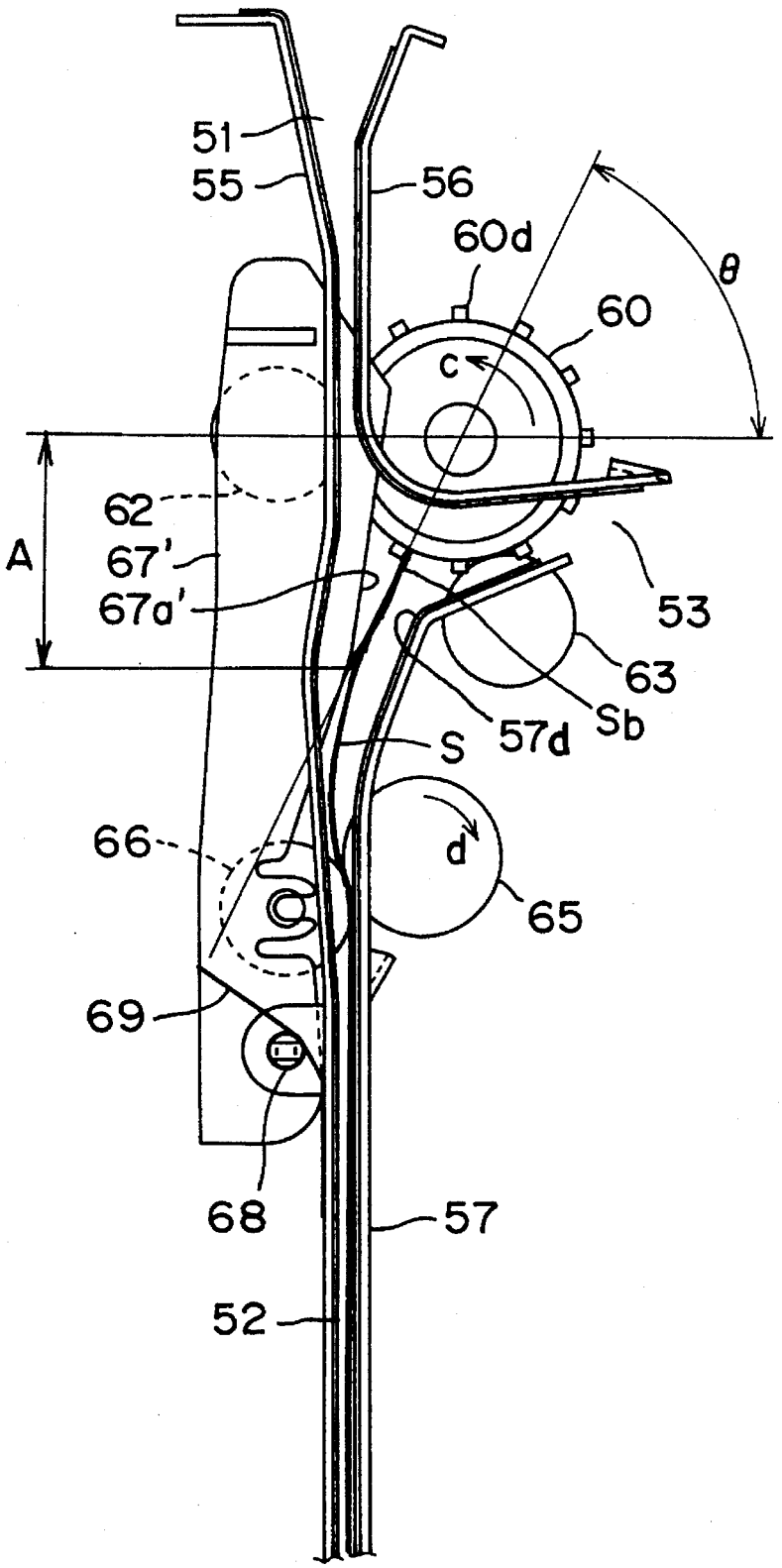

In the second embodiment, levers 67' shown in FIG. 12 and 13 are employed instead of the levers 67. Each of the levers 67' has a guide portion 67*a*' which extends vertically, and because of the guide portion 67*a*', the timing of returning to the home position becomes late. The guide portion 67*a*' extends from the nipping portion of the transport roller 60 and the guide roller 62 to the reversing path 52 by a length A and advances in the path through the guide plate 55*a*.

The sheet S which comes to the transport roller 60 and the guide roller 62 is fed into the reversing path 52 while pushing the guide portions 67*a*' of the levers 67'. While the returning timing of the levers 67' is delayed, the transport roller 60 rotates by an angle θ shown in FIG. 13. In the structure, the timing of starting the sheet feed-back by the reversing rollers 65 and 66 is delayed, and there is substantially no time when the trailing edge Sb of the sheet S is pushed between the paddles 60*d* and the reversing rollers 65 and 66. Therefore, even if the edge Sb of the sheet S curls toward the levers 67', the edge Sb of the sheet S can be certainly guided into the nipping portion of the transport roller 60 and the guide roller 63 without bending.

Further, in the second embodiment, the guide plate 57 has an angular portion 57*d* near the guide roller 63. If the edge Sb of the sheet S is bending toward the guide plate 57, the angular portion 57*d* supports the sheet S and prevents the bending.

Third Embodiment

Figure 14:
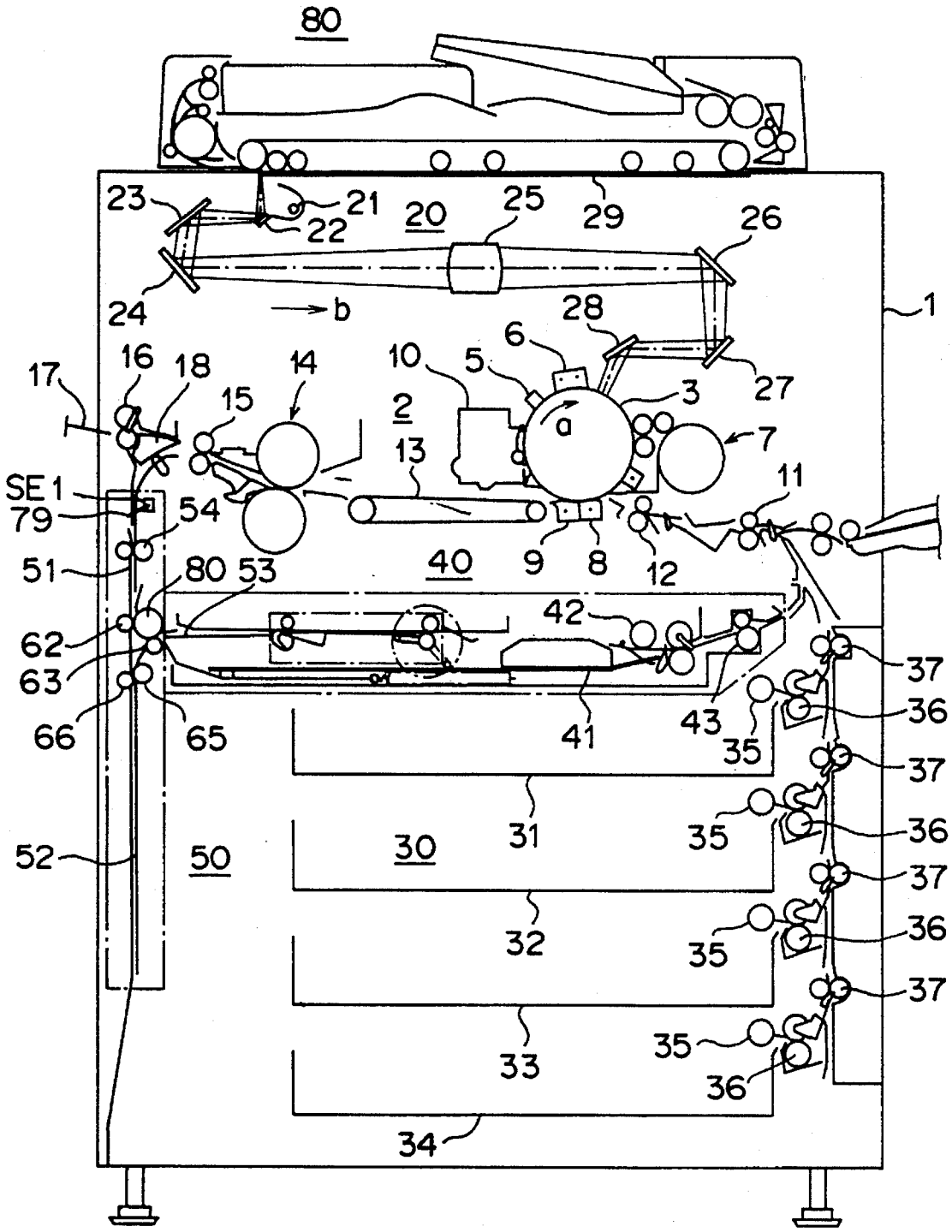
FIG. 14 is an elevational view of a copying machine provided with a sheet reversing unit which is a third embodiment of the present invention, showing the internal composition.

FIG. 14 shows the general structure of a copying machine provided with a sheet reversing unit which is a third embodiment of the present invention. This copying machine has basically the same structure as the copying machine of FIG. 1. The members and parts in FIG. 14 which are the same as those in FIGS. 1 are provided with the same reference symbols, and the description of these members and parts is omitted here.

In the third embodiment shown in FIG. 14, there are different points from the first embodiment shown in FIG. 1 as follows: the structure and action of a transport roller 80 are different from the transport roller 60 of the first embodiment; and a sensor SE1 with an actuator 79 is provided in the take-in path 51. The sensor SE1 detects a sheet passing through the take-in path 51, and a detection signal of the sensor SE1 is used to judge a sheet jam in cooperation with a timer and to control the sheet reversing unit 50.

Structure of the Transport Roller

Figure 21:
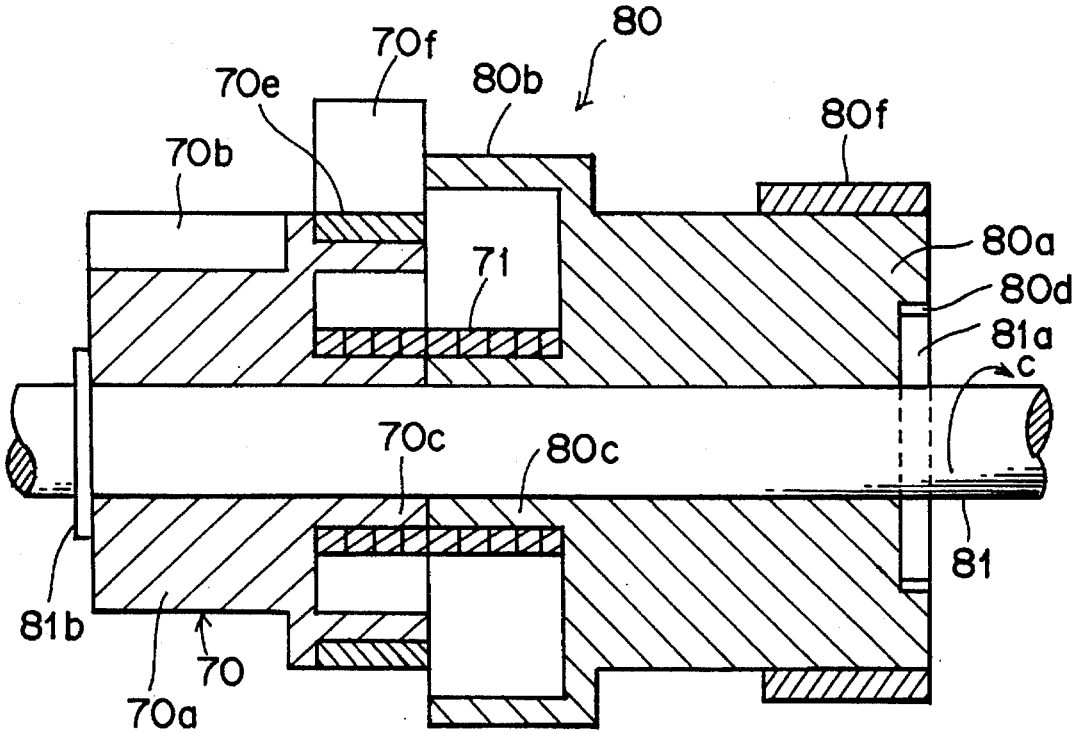
FIG. 21 is a sectional view of a wheel of a transport roller and a wheel of a paddle roller provided in the third sheet reversing unit.

The transport roller 80 has a plurality of wheels fixed around a shaft 81. As shown in FIG. 21, each wheel has a collar 80*b* provided around a center roll 80*a* and a rubber ring 80*f* fixed on the center roll 80*a*. The collar 80*b* has a slightly larger diameter than the ring 80*f*. The wheels are driven to rotate in a direction of arrow c by a rotating force which is applied by a transport motor and transmitted via the shaft 81. The wheels of the rollers 62 and 63 are pressed against the rings 80*f*. Next to each wheel of the transport roller 80, a wheel of a paddle roller 70 is fitted around the shaft 81. Grooves 80*d* are made on the end surface of the center roll 80*a* which does not abut on the paddle wheel, and both ends of a pin 81*a* which pierces through the shaft 81 engages with the grooves 80*d*. Thereby, the center roll 80*a* rotates together with the shaft 81. On the end surface of the paddle wheel which does not abut on the center roll 80*a*, an E ring 81*b* is fitted on the shaft 81. Thus, the wheel of the transport roller 80 and the wheel of the paddle roller 70 can be positioned on the shaft 81 by the engagement of the grooves 80*d* and the pin 81*a* and by the E ring 81*b*.

Figure 22:
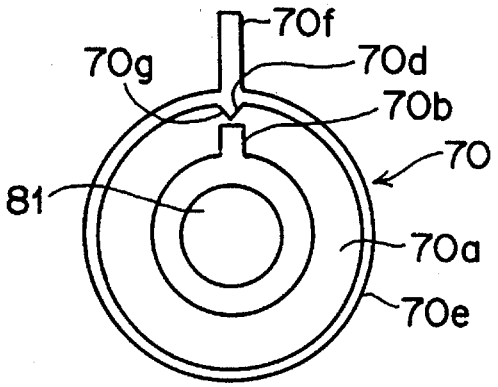
FIG. 22 is a side view of the wheel of the transport roller and the wheel of the paddle roller, showing the main parts thereof.

Each wheel of the paddle roller 70 has a center roll 70*a* with a tab 70*b* and a paddle ring 70*e* with an elastic paddle 70*f* on the outer surface. The paddle ring 70*e* is fixed on the center roll 70*a*. As shown in FIG. 22, the elastic paddle 70*f* of the paddle ring 70*e* is positioned accurately by the side of the tab 70*b*. For the positioning, a recess 70*d* is made on the center roll 70*a*, and a projection 70*g* which engages with the recess 70*d* is provided on the inner surface of the paddle ring 70*e*.

The transport roller 80 rotates at all times, while the paddle roller 70 makes one rotation at a specified timing which will be described in detail later. For the rotation of the paddle roller 70, a clutch mechanism and clutch connecting/disconnecting means are provided. The center rolls 70*a* of the wheels of the paddle roller 70 are loosely fitted to the shaft 81 so as to freely rotate. A kick spring 71 is wound around the adjoining center rolls 70*a* and 80*a* between a boss 70*c* and a boss 80*c*. The wheels of the transport roller 80 rotate in synchronization with rotation of the shaft 81 in the direction of arrow c, and the rotating forces of the wheels of the transport roller 80 are transmitted to the wheels of the paddle roller 70 via the respective kick springs 71.

Figure 23:
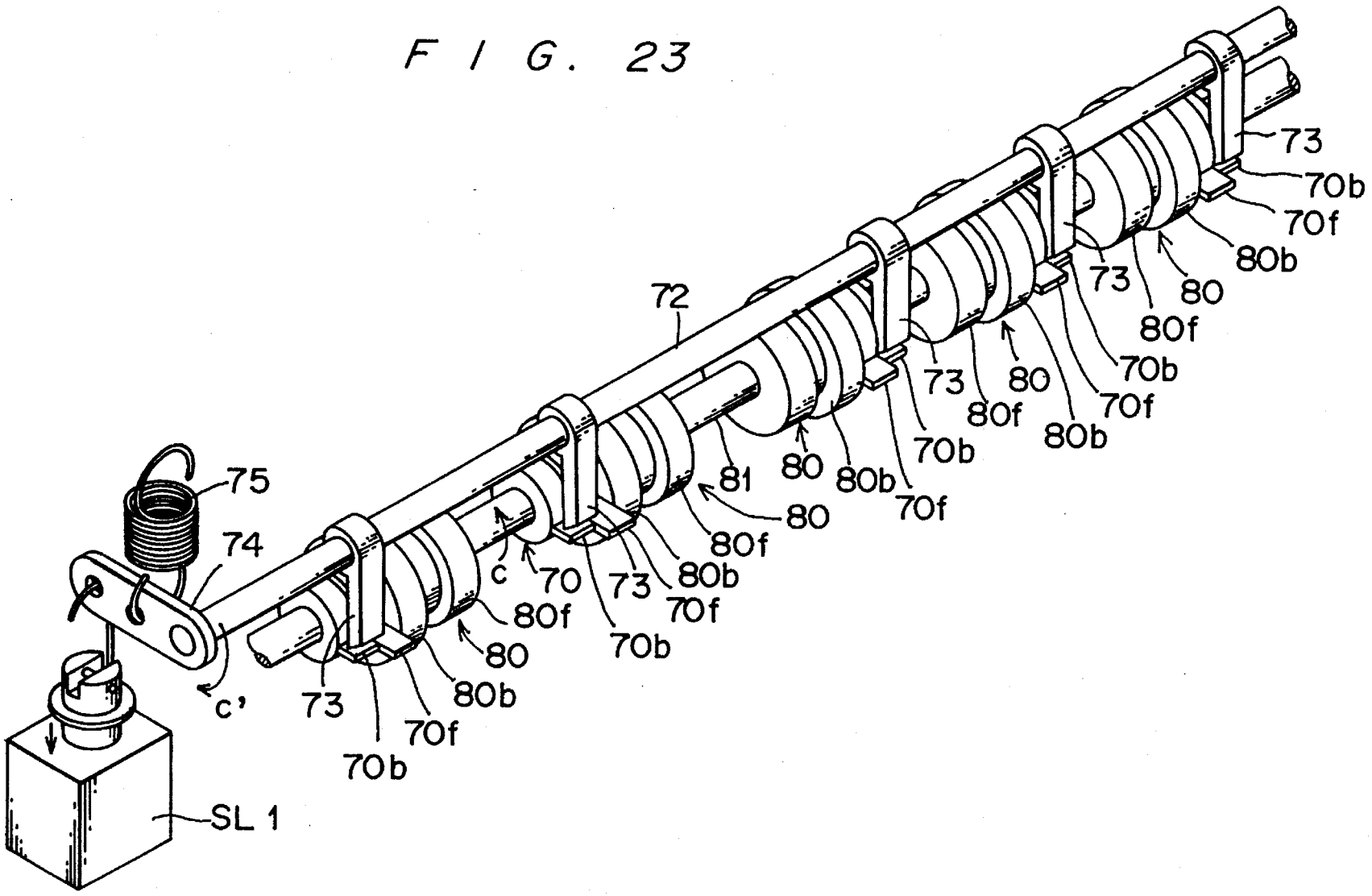
FIG. 23 is a perspective view of the transport roller and the paddle roller.

The clutch connecting/disconnecting means is illustrated in FIG. 23. Stoppers 73 are fixed on a shaft 72, and an end of the shaft 72 is connected to a solenoid SL1 via an arm 74. The arm 74 is urged in a direction of c' by a coil spring 75. While the solenoid SL1 is off, the edge of each stopper 73 is located in the locus of rotation of the tab 70*b*, and the tab 70*b* moving in the direction of arrow c hits the stopper 73. Thereby, the kick spring 71 slips on the boss 80*c* of the center roll 80*a* of the adjoining transport wheel. Thus, only the wheels of the transport roller 80 rotate in the direction of arrow c. When the solenoid SL1 is turned on, the arm 74 and the shaft 72 supporting the stoppers 73 are turned slightly in the opposite direction to arrow c'. Thereby, the engagements of the stoppers 73 with the tabs 70*b* are broken, and the rotation of the shaft 81 is transmitted to the wheels of the paddle roller 70 via the kick springs 71. Thus, the wheels of the paddle roller 70 rotate in the direction of arrow c in synchronization with the wheels of the transport roller 80.

Action of the Sheet Reversing Unit

Now, the action of the sheet reversing unit of the third embodiment is described.

Figure 15:
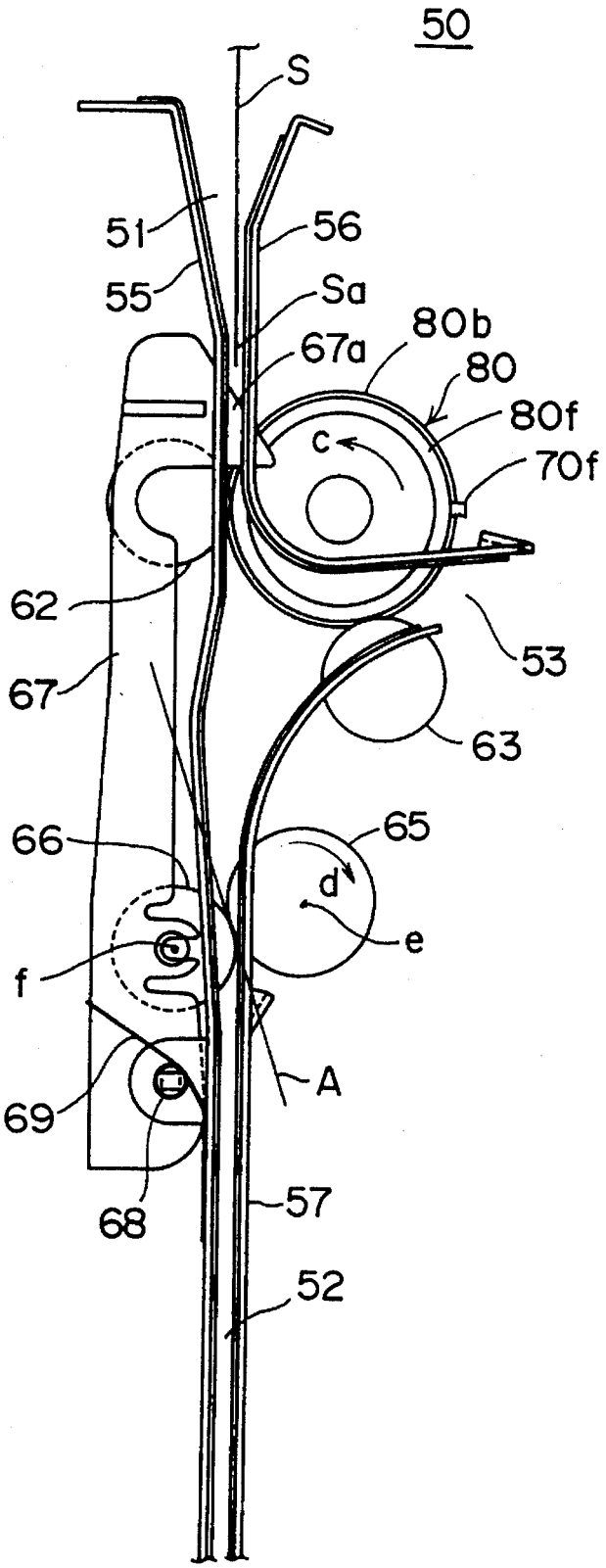
FIGS. 15, 16, 17, 18, 19 and 20 are sectional views of the third sheet reversing unit, explaining the action.
Figure 16:
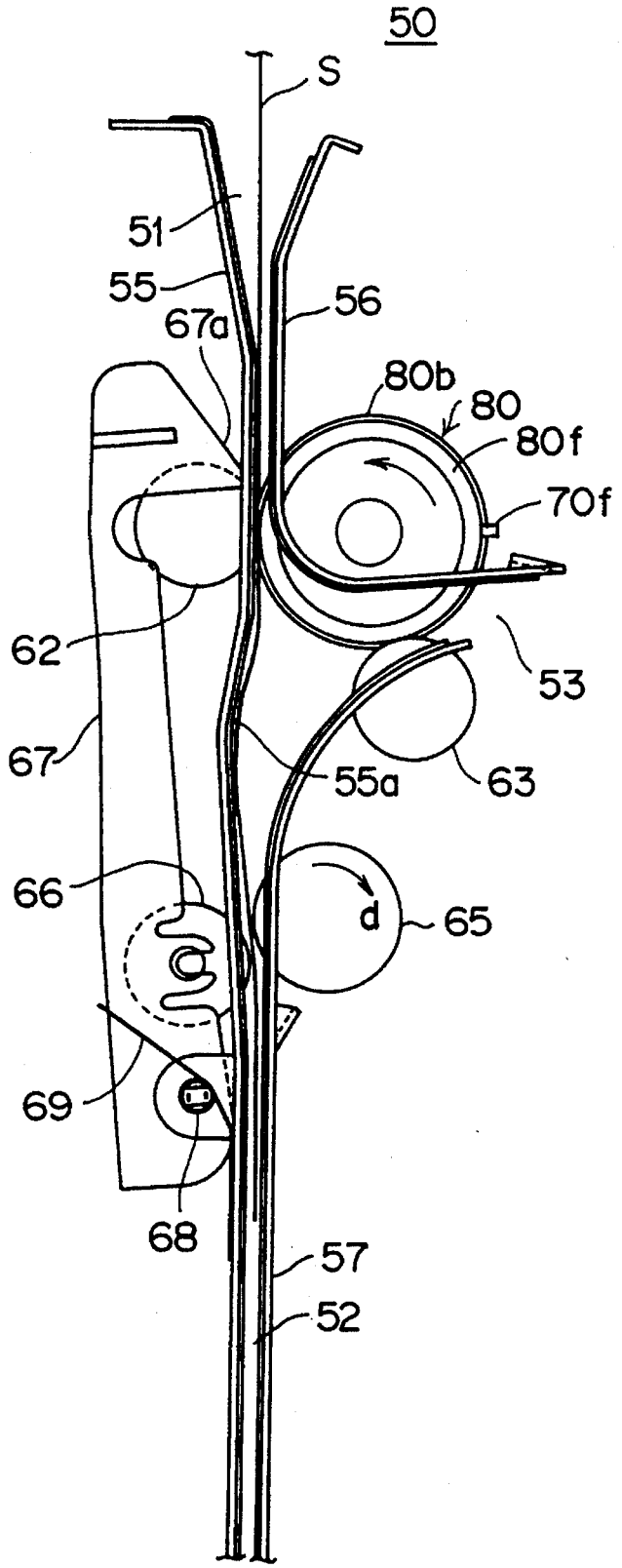

In reversing a sheet, the transport roller 80 is driven to rotate in the direction of arrow c, and the first reversing roller 65 is driven to rotate in the direction of arrow d. A sheet S which has received an image on the first side is guided to the take-in path 51 of the reversing unit 50 by the diverging pawl 18 and is fed downward by the transport roller pair 54. When the leading edge Sa of the sheet S reaches the pawls 67*a* of the levers 67, the levers 67 turn counterclockwise in FIG. 15 on the pin 68, and thereby the pawls 67*a* retreat from the take-in path 51. Then, the sheet S comes to the nipping portion of the rollers 80 and 62 and is fed straight down to the reversing path 52 by the rollers 80 and 62. By the counterclockwise turn of the levers 67, the second reversing roller 66 moves away from the first reversing roller 65 (see FIG. 16), and the sheet S goes downward between the rollers 65 and 66. In this moment, although the first reversing roller 65 is rotating in the direction of d, the sheet S, even if the sheet S has a small specific gravity, goes downward smoothly because there is a space between the rollers 65 and 66.

Figure 17:
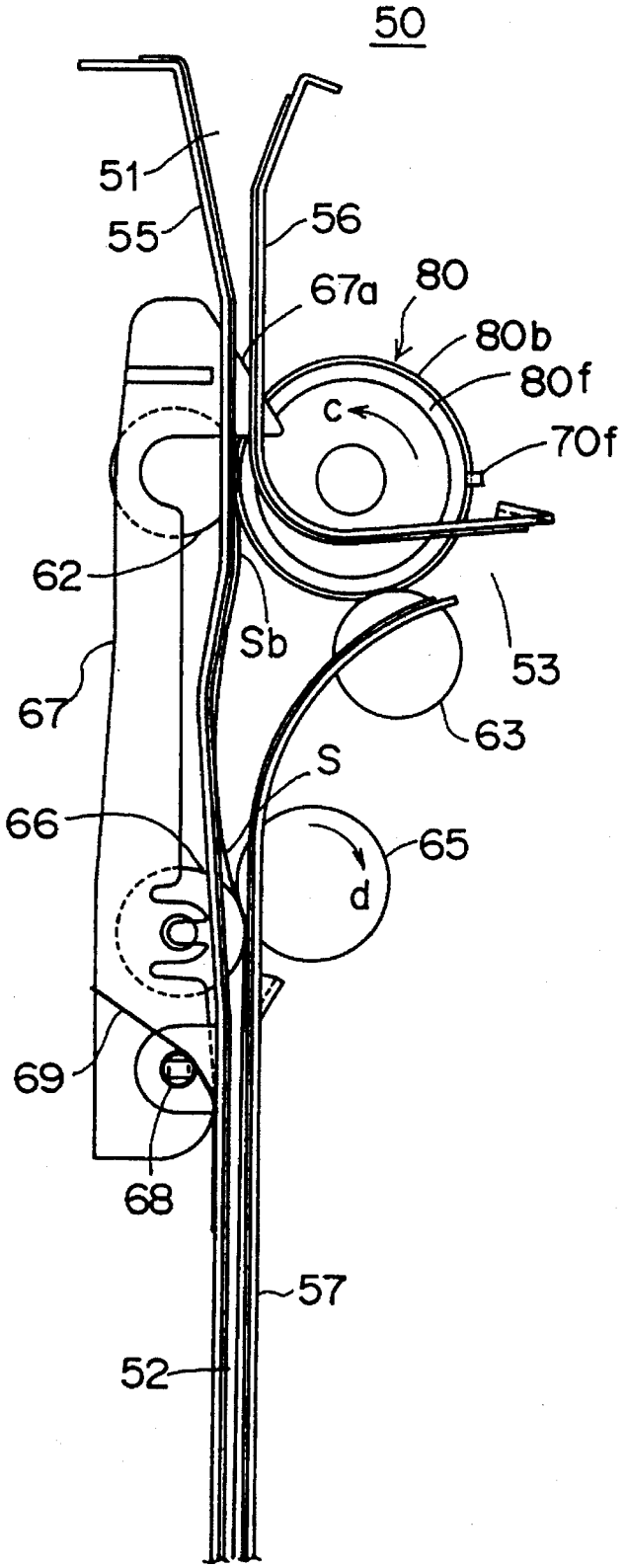
Figure 24:
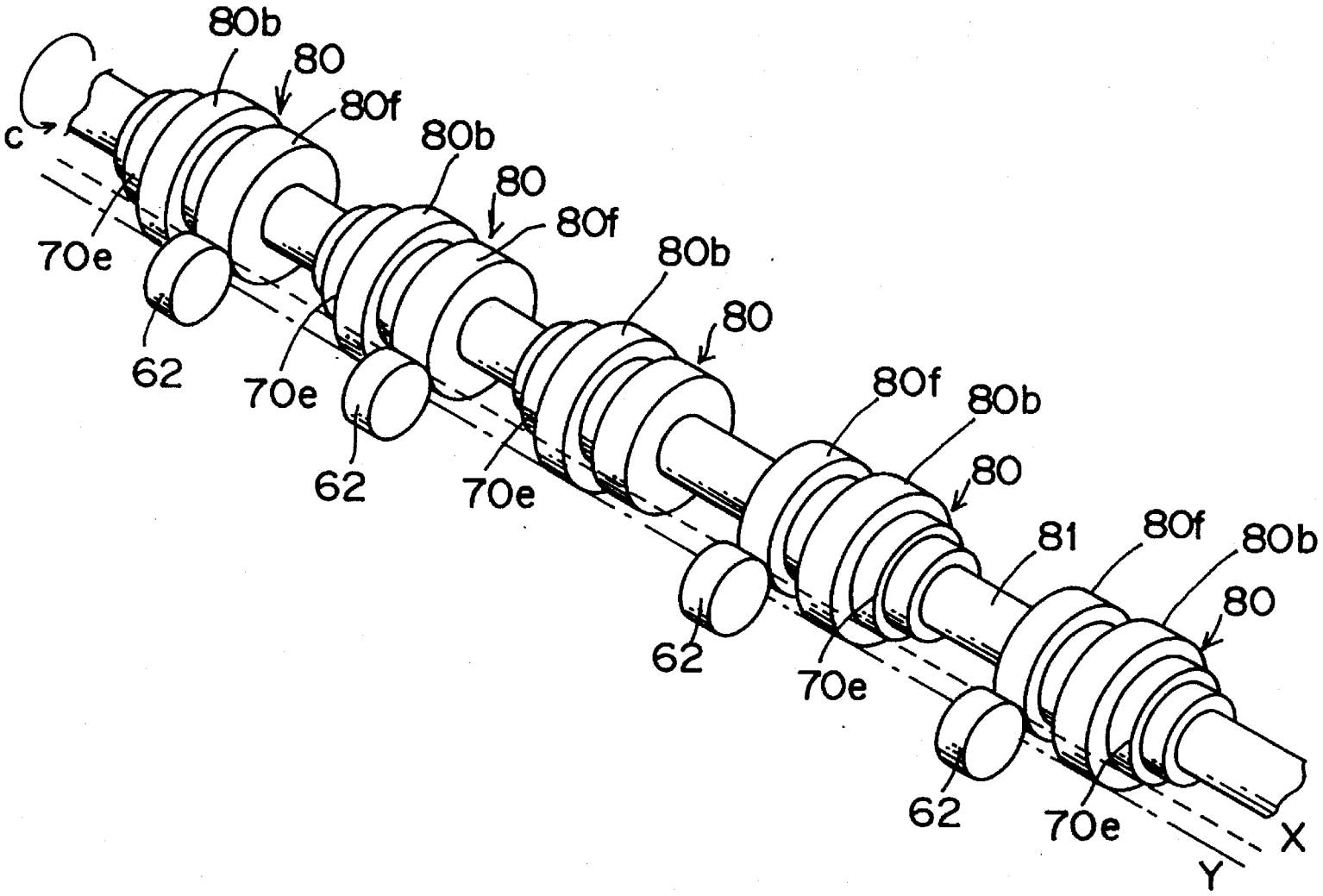
FIG. 24 is a perspective view of the transport roller and a pressing roller.
Figure 25:
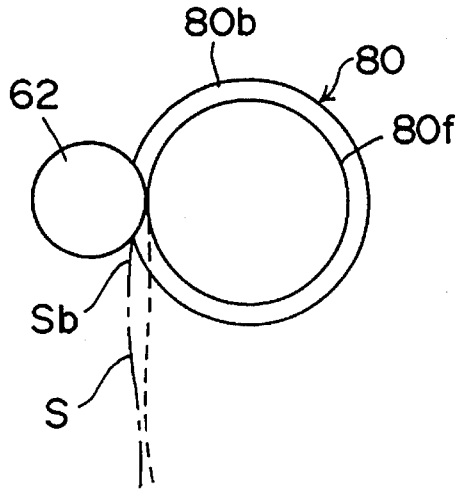
FIG. 25 is a cross sectional view of a wheel of the transport roller and a wheel of the pressing roller, showing the motion of a trailing edge of a sheet around the nipping portion of the rollers.

When the trailing edge Sb of the sheet S passes through the pawls 67*a* of the levers 67, the levers 67 turn clockwise by the forces of the torsion springs 69 (see FIG. 17). Accordingly, the pawls 67*a* advance into the take-in path 51, and the second reversing roller 66 comes into contact with the first reversing roller 65. Thereby, the rotating force of the first reversing roller 65 in the direction of arrow d acts on the sheet S. In the meantime, the trailing edge Sb of the sheet S passes through the nipping portion of the rings 80*f* and the wheels of the guide roller 62 and goes downward a little by inertia to an apparent nipping portion of the collars 80*b* and the guide roller 62. The dashed line X in FIG. 24 indicates the nipping portion of the rings 80*f* and the guide roller 62, and the alternate long and short dash line Y in FIG. 24 indicates the apparent nipping portion of the collars 80*b* and the guide roller 62. FIG. 25 illustrates the movement of the edge Sb of the sheet S from the nipping portion of the rings 80*f* and the roller 62 to the apparent nipping portion of the collar 80*b* and the roller 62.

The outer surfaces of the collars 80*b* are finished to have a low coefficient of friction. Thereby, no transporting force is generated between the collars 80*b* and the roller 62, and the trailing portion of the sheet S slips here. In this moment, although the rotating force of the first reversing roller 65 acts on the sheet S, the upward force by the roller 65 is small and only in such an extent to prevent the sheet S from dropping down.

Figure 26:
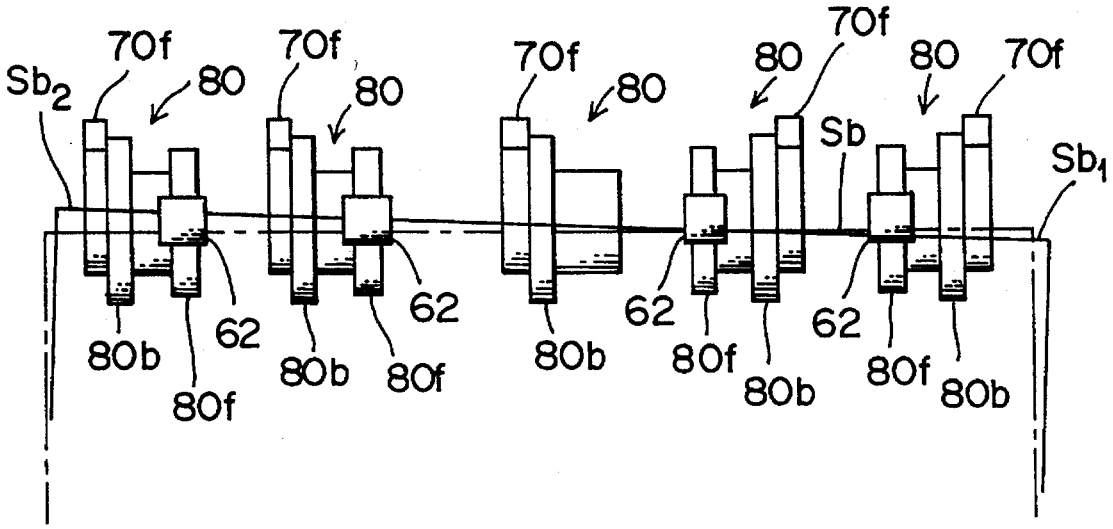
FIG. 26 is a front view of the transport roller and the pressing roller, showing correction of the skew of a sheet.

If the sheet S is fed into the reversing path 52 askew (see FIG. 26), one side $Sb_1$ of the sheet S is ahead of the other side $Sb_2$. However, while the side $Sb_1$ of the trailing portion of the sheet S is slipping in the apparent nipping portion of the rollers 80 and 62, the side $Sb_2$ catches up with the side $Sb_1$. Thus, the skew of the sheet S is corrected.

Figure 18:
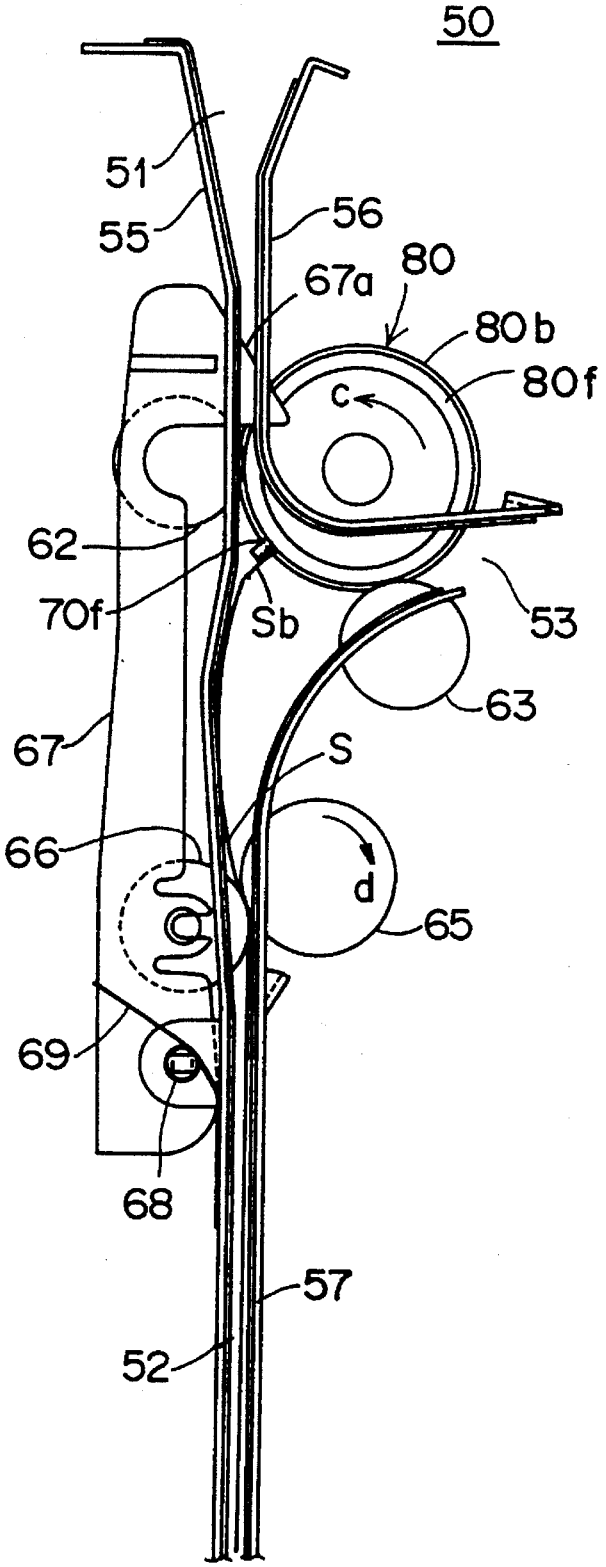
Figure 19:
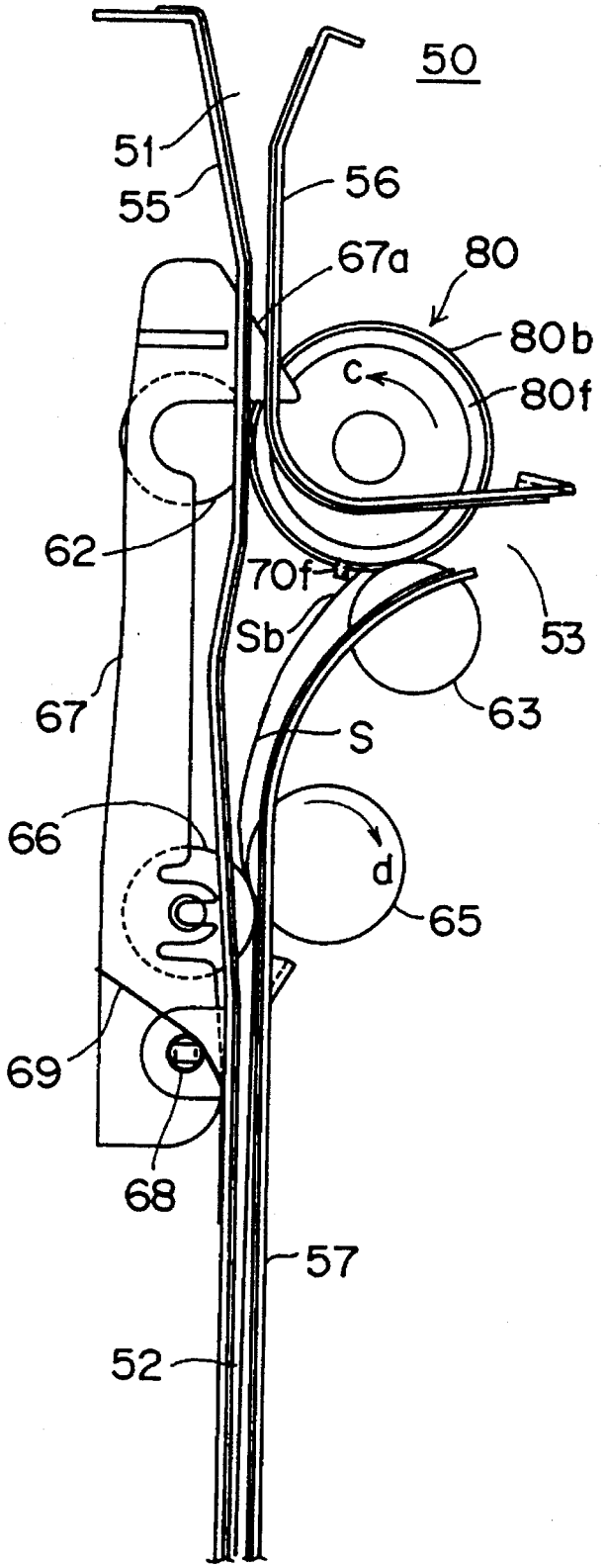
Figure 20:
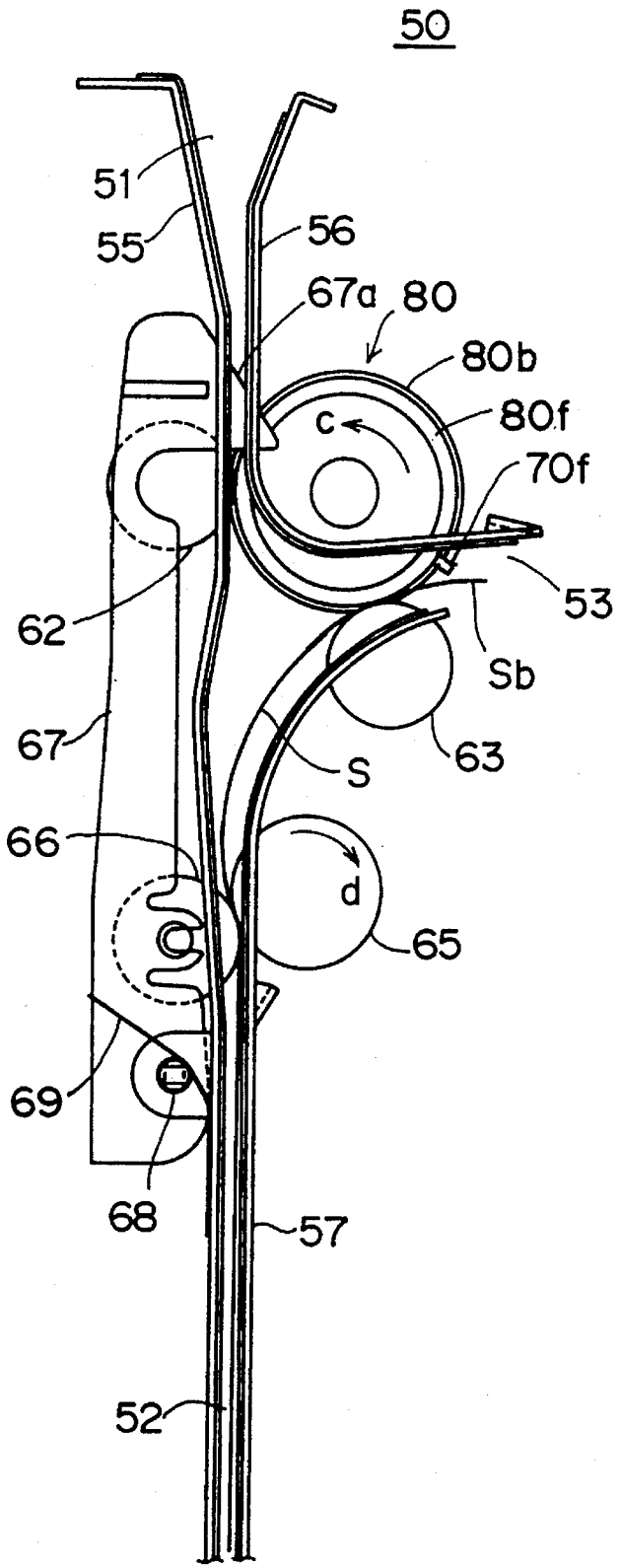

Meanwhile, the solenoid SL1 is kept off, and the wheels of the paddle roller 70 are stopped by the stoppers 73. The paddles 70*f* are in a retreating position outside the take-in path 51 not to obstruct the sheet S. A specified time after the sensor SE1 detects the trailing edge Sb of the sheet S, the solenoid SL1 is turned on. Thereby, the paddle roller 70 rotates in the direction of arrow c together with the transport roller 80. Then, the paddles 70*f* catch the trailing edge Sb of the sheet S (see FIG. 18) and moves the edge Sb along the circumferences of the wheels of the transport roller 80 to the guide roller 63 (see FIG. 19). Once the edge Sb of the sheet S comes to the nipping portion of the transport roller 80 and the guide roller 63, the sheet S is fed in the take-out path 53 (see FIG. 20) and received by the refeeding unit 40 upside down.

The solenoid SL1 is turned off immediately, and the stoppers 73 comes back in engagement with the tabs 70*b* which has made one rotation. Thus, the paddle roller 70 only makes one rotation for reversing of a single sheet.

The timing of rotating the paddle roller 70, that is, the timing of turning on the solenoid SL1 is controlled by a timer which is started when the sensor SE1 detects the trailing edge Sb of the sheet S. The value set in the timer T meets the following condition:

$$T \geqq (t_1 + \ ) - (t_2 + t_3) \quad (1)$$

T: time from the moment when the sensor SE1 detects the trailing edge of a sheet to the moment when the solenoid SL1 is turned on $t_1$: time required for movement of the trailing edge of the sheet from the detection point of the sensor SE1 to the nipping portion of the collars 80*b* and the guide roller 62 (distance L shown in FIG. 17)

α: time required for correction of skew of the sheet in the apparent nipping portion of the collars 80*b* and the guide roller 62

$t_2$: time required for movement of the paddles 70*f* from the retreating position to the apparent nipping portion of the collars 80*b* and the guide roller 62 (angle θ shown in FIG. 17)

$t_3$: time from the moment when an on-signal is sent to the solenoid SL1 to the moment when the paddles 70*f* actually starts moving actuated by the solenoid SL1

Because the transport roller 80 and the paddle roller 70 are structured in the above-described way and because the paddles 70*f* move with a time lag, the trailing portion of a sheet slips in the nipping portion of the rollers 80 and 62, and thereby, possible skew of the sheet can be effectively corrected. The paddles 70*f* are rotated only to push the trailing edge of a sheet along the circumference of the transport roller 80, and in the other moments, the paddles 70*f* are out of contact with the sheet. Therefore, there is no fear that the paddles 70*f* may scratch or crease the sheet. As mentioned, the paddles 70*f* are elastic. Also, the paddles 70*f* must be repulsive sufficiently to push the sheet toward the guide roller 63 against the feed-back force of the first reversing roller 65.

In order to move and stop the paddles 70*f*, the kick springs 71 are used as a torque limiter (see FIG. 21). While the paddles 70*f* are in the retreating position, the tightening forces of the kick springs 71 are loaded on the transport motor, and it is not preferred that the tightening forces of the kick springs 71 (torque limit value) are too large. However, the torque limit value must be large sufficiently to enable the paddles 70*f* to push the trailing edge of a sheet to the guide roller 62 against the force of the first reversing roller 65. The torque limit value is determined on consideration of these points.

As shown in FIG. 23, five paddles 70*f* are arranged in a perpendicular direction to the sheet traveling direction, and the paddles 70*f* are fitted to the shaft 81 individually. Therefore, the paddles 70*f* must have the same rotation phase. As shown in FIG. 22, each paddle ring 70*e* and center roll 70*a* are set by the engagement of the projection 70*d* with the recess 70*g* such that the tab 70*b* of the center roll 70*a* and the paddle 70*f* of the paddle ring 70*e* can be positioned accurately side by side. Besides, the stoppers 73 which are to engage with the tabs 70*d* are fixed around the shaft 72 to have the same phase. Thus, when the stoppers 73 come into engagement with the respective tabs 70*d*, the paddles 70*f* are put into alignment to have the same rotation phase. To set the paddles 70*f* to have the same phase is important for effective correction of possible skew of a sheet.

Figure 27:
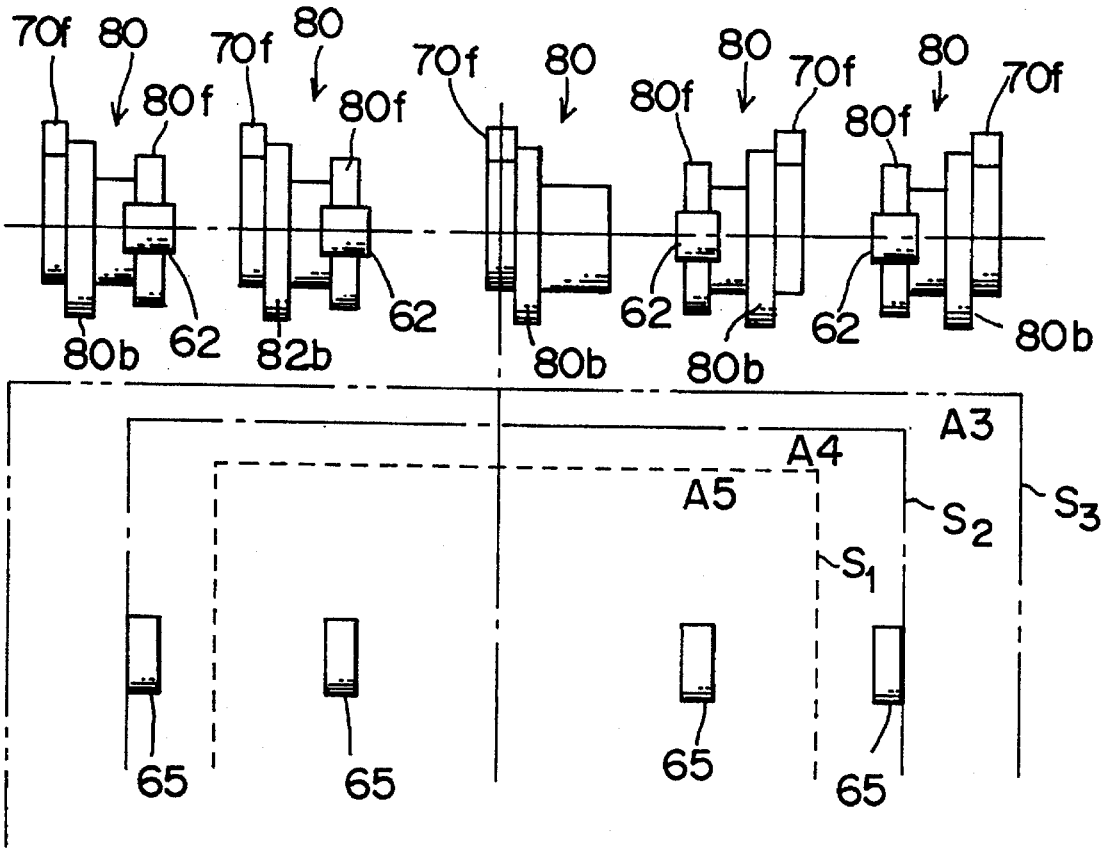
FIG. 27 is an illustration showing the positional relationship between the wheels of the transport roller, the paddle roller and the pressing roller and sheet of various sizes.
Figure 28:
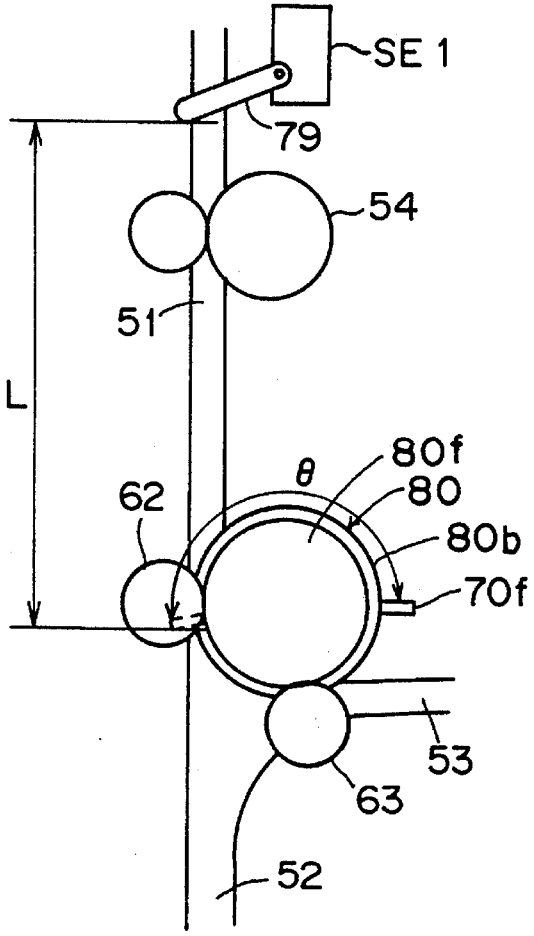
FIG. 28 is an illustration showing the timing of rotating the paddle roller.

Now, the collars 80*b* of the wheels of the transport roller 80 are described. The correction of possible skew of a sheet in the apparent nipping portion (alternate long and short dash line Y in FIG. 24) of the collars 80*b* and the guide roller 62 cannot be certainly carried out unless a sheet of the minimum size is under the influence of at least two sets of a collar 80*b* and a wheel of the guide roller 62. FIG. 27 illustrates the positions of the collars 80*b* of the transport roller 80 and the wheels of the guide roller 62 with respect to sheets of various sizes $S_1$, $S_2$ and $S_3$. In the positioning of FIG. 27, a sheet of the minimum size $S_1$ is under the influence of two sets of a collar 80*b* and a wheel of the guide roller 62.

The collars 80*b* are integral with the respective center rolls 80*a*, and rotate all the time during reversing operation. It is possible to instead of the collars 80*b*, provide curved plates with a low coefficient of friction separately from the center rolls 80*a*. However, the structure of the third embodiment which has the collars 80*b* rotating all the time has the following advantages over the structure which has the curved plates instead of the collars 80*b*: the resistance of the collars 80*b* against a sheet is much smaller than that of the curved plates; and the trailing edge of the sheet is prevented from coming back to the nipping portion.

Further, preferably, the collars 80*b* have a larger diameter than the rings 80*f* which are pressed against the wheels of the guide roller 62. In this case, the apparent nipping portion (line Y in FIG. 24) of the collars 80*b* and the guide roller 62 is located under the nipping portion (line X in FIG. 24) of the rings 80*f* and the guide roller 62. Thereby, while the trailing portion of a sheet is slipping in the apparent nipping portion of the collars 80*b* and the guide roller 62, though the sheet is provided with the force of the first reversing roller 65, the trailing edge will never be pushed to the nipping portion of the rings 80*f* and the guide roller 62. Thus, the correction of possible skew of the sheet can be certainly carried out. However, the diameter of the collars 80*b* must not be so large that the collars 80*b* obstruct the movement of the edge of the sheet to the nipping portion of the rings 80*f* and the guide roller 63.

Figure 29:
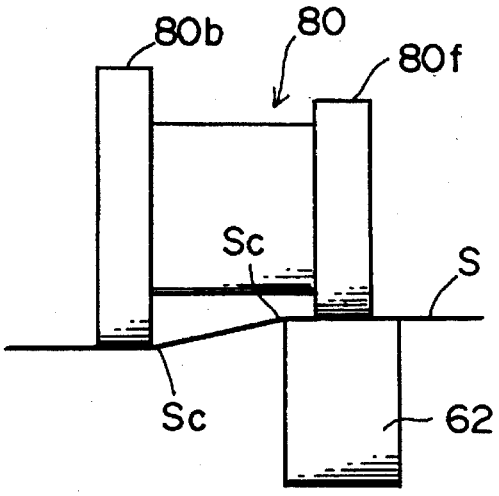
FIG. 29 is an illustration showing the distance between a collar and a ring of a wheel of the transport roller.
Figure 30:
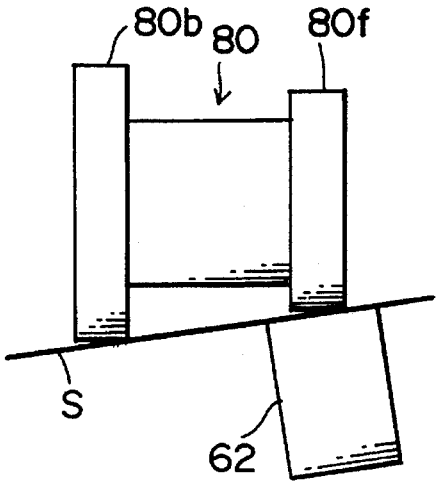
FIG. 30 is an illustration showing the distance between a collar and a ring of a wheel of the transport roller.

Next, the distance between the collar 80*b* and the ring 80*f* of each wheel of the transport roller 80 is described. If the distance is too small, an end of the wheel of the guide roller 62 and an end of the collar 80*b* are so close that the sheet may get impressions of the ends Sc (see FIG. 29). Also, the wheel of the guide roller 62 may be in contact with the ring 80*f* slantingly, and a sufficient nipping force cannot be generated (see FIG. 30). On the other hand, if the distance is too large, while the trailing portion of a soft sheet is slipping in the apparent nipping portion of the collars 80*b* and the guide roller 62, the trailing portion may come into the nipping portion of the rings 80*f* and the guide roller 62, and possible skew of the sheet may not be corrected. The distance between the ring 80*f* and the collar 80*b* of each wheel of the transport roller 80 is determined on consideration of these points.

Preferably, the transporting forces of the rollers meet the following condition:

$$F_1>F_0>F_2>F_3 \quad (2)$$

$F_0$: stiffness of a sheet, that is, repulsive force of the trailing portion in the apparent nipping portion of the collars 80*b* and the guide roller 62 when the sheet is held by the reversing rollers 65 and 66

$F_1$: transporting force of the paddles 70*f*, that is, the force of the paddles 70*f* to push down the trailing edge of a sheet from the apparent nipping portion of the collars 80*b* and the guide roller 62

$F_2$: feed-back force generated by the reversing rollers 65 and 66

$F_3$: maximum weight of a sheet of the maximum size plus inertia when the sheet is fed from the nipping portion of the rings 80*f* and the guide roller 62

If the force $F_1$ is smaller than the forces $F_0$ and $F_1$, the paddles 70*f* cannot push a sheet to the guide roller 63. If the force $F_2$ is larger than the force $F_0$, the leading (lower) portion of a sheet will not slip in the nipping portion of the reversing rollers 65 and 66, and the trailing edge of the sheet will be bent. If the force $F_2$ is smaller than the force $F_3$, the reversing rollers 65 and 66 cannot hold a sheet, and the trailing edge of a sheet will not be in the apparent nipping portion of the collars 80*b* and the guide roller 62 when the paddles 70*f* are rotated, thereby disabling the paddles 70*f* from pushing the sheet to the guide roller 63.

Figure 31:
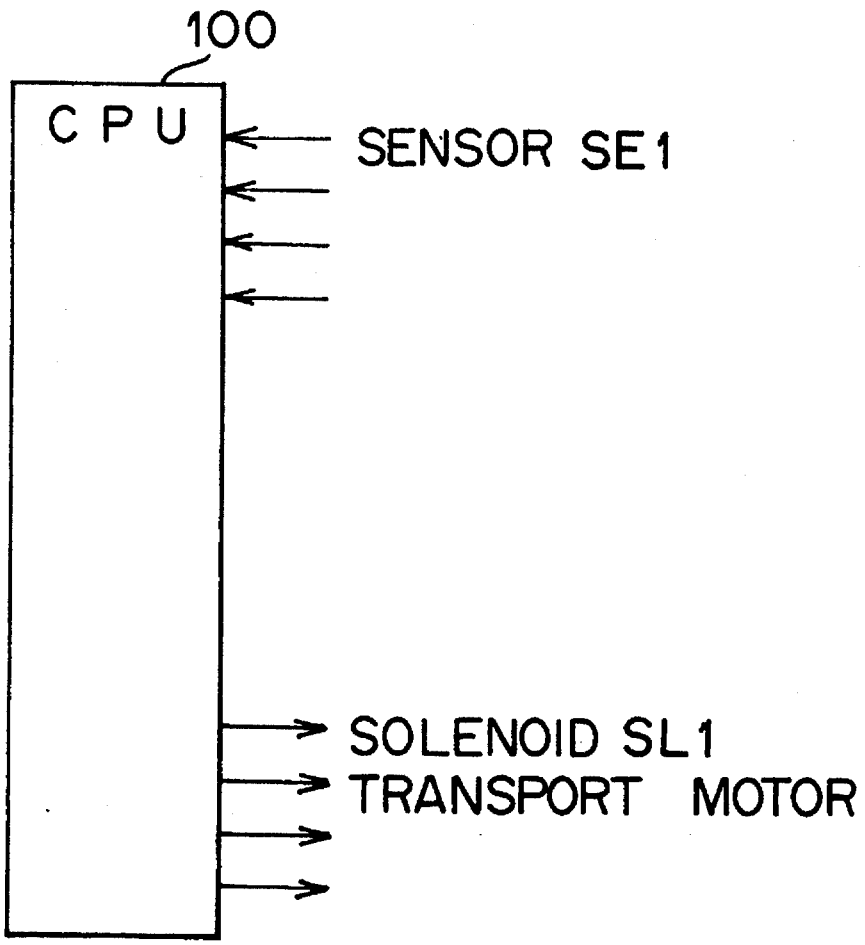
FIG. 31 is a block diagram of a control circuitry of the copying machine.

As shown in FIG. 27, five wheels of the transport roller 80 are arranged in the perpendicular direction to the sheet traveling direction, and the middle wheel does not have a ring 80*f*. The guide roller 62 has four wheels which are arranged to engage with the four rings 80*f* of the transport roller 80 respectively. The guide roller 63 has the same structure. Each of the reversing rollers 65 and 66 has four wheels which are arranged in positions corresponding to the rings 80*f* of the transport roller 80. The positional relationship between the rollers and sheets of the sizes A5-vertical, A4-vertical and A3-vertical ("vertical" means a case of feeding a sheet with the longer sides parallel to the sheet traveling direction) is apparent from FIG. 27. Control Circuitry and Control Procedure FIG. 31 shows a control circuitry which controls the copying machine 1. The main element of the control circuitry is a CPU 100. Signals from various sensors such as the sheet sensor SE1 are inputted to the CPU 100, and signals for controlling the solenoid SL1, the transport motor, etc. are outputted from the CPU 100.

Next, a control procedure carried out by the CPU 100 is described.

Figure 32:
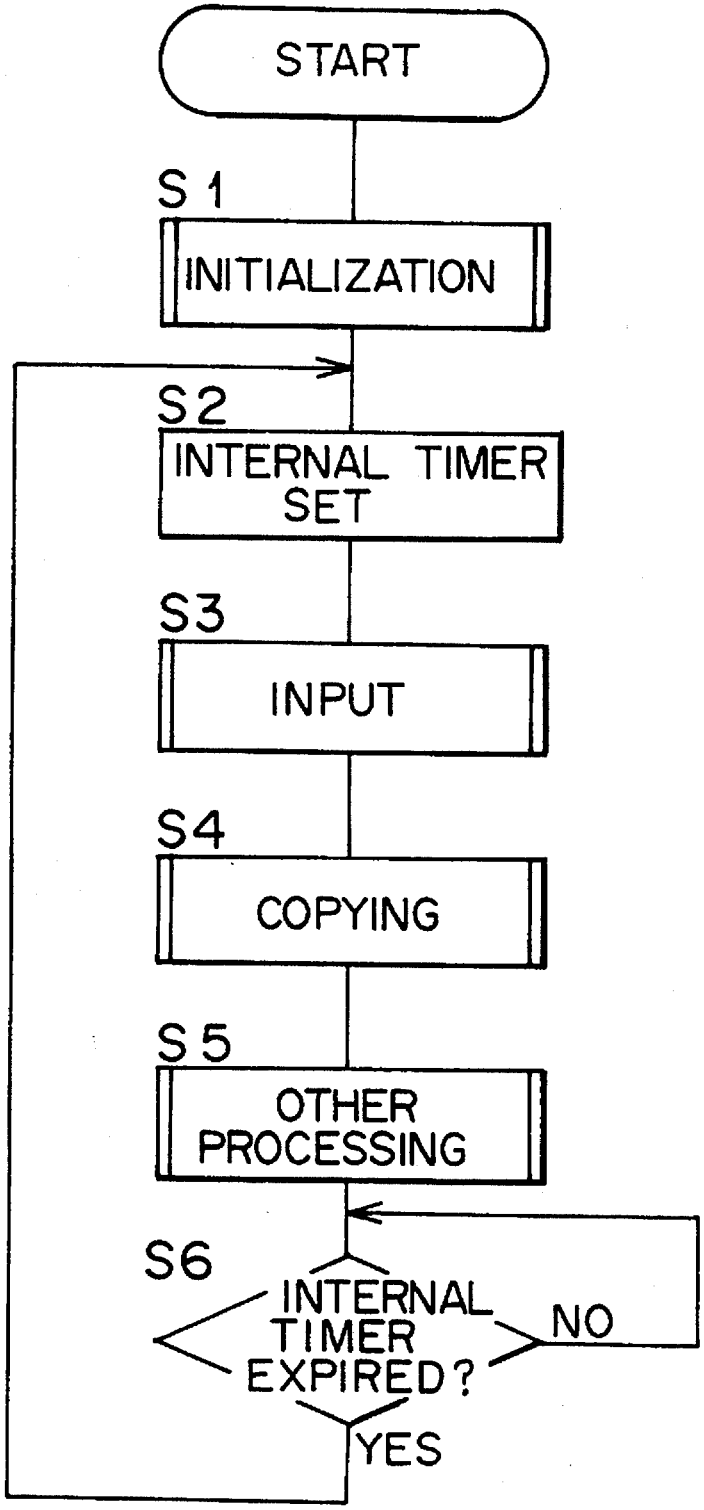
FIG. 32 is a flowchart showing a main routine of a CPU of the control circuitry.

FIG. 32 shows a main routine of the CPU 100. When the power of the copying machine 1 is turned on, the program is started. At step S1, an internal RAM and registers are cleared, and members and devices are initialized. At step S2, an internal timer is set. This internal timer determines a time for one cycle of the main routine, and the value of the timer is determined at step S1. At steps 3, 4 and 5, subroutines are called successively. Then, on confirmation of the expiration of the timer at step S6, the processing returns to step S2. At step S3, copying data (about copying magnification, sheet size, etc.) which are inputted by the operator on an operation panel (not shown) are entered. At step S4, copying is carried out. At step S5, other control such as the temperature regulation of the fixing device 14 is carried out.

Figure 33:
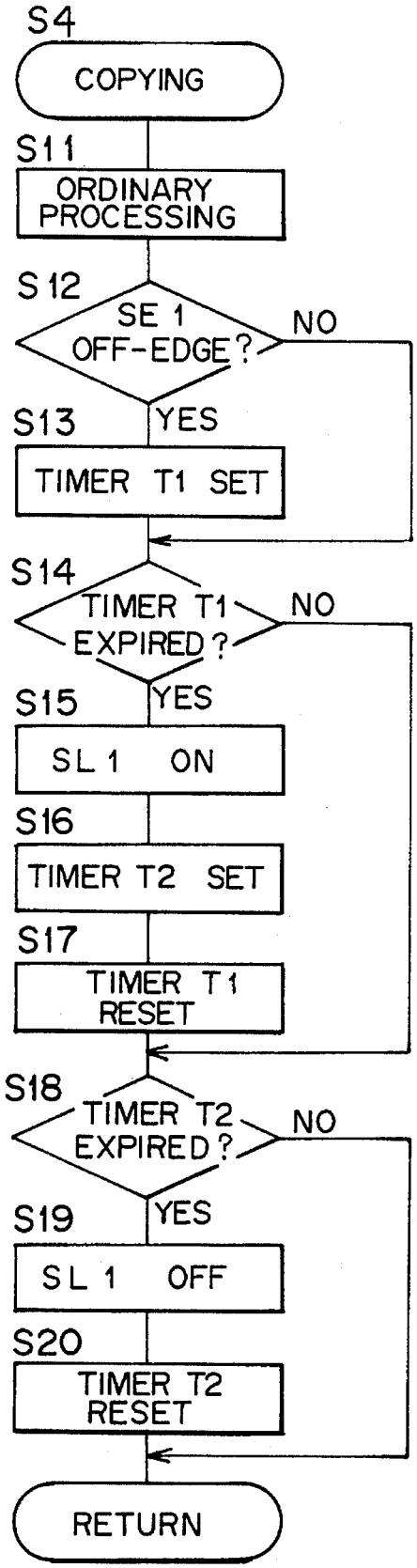
FIG. 33 is a flowchart showing a copying subroutine of the CPU.

FIG. 33 shows a copying subroutine carried out at step S4. First, at step S11, ordinary processing for copying, that is, operation of the image forming section 2, the optical system 20 and the sheet feeding section 30, etc. is carried out. This processing is well known, and the detailed description is omitted.

When an off-edge of the sensor SE1 provided in the take-in path 51 of the reversing unit 50 is confirmed at step S12, that is, when the trailing edge of a sheet is detected by the sensor SE1, a timer T1 is set at step S13. The value T of the timer T1 is determined so as to meet the condition (1). On confirmation of the expiration of the timer T1 at step S14, the solenoid SL1 is turned on at step S15, a timer T2 is set at step S16, and the timer T1 is reset at step S17. By the turning-on of the solenoid SL1, the paddles 70*f* starts moving from the retreating position in the direction of arrow c to push the trailing edge of the sheet (see FIGS. 17 through 20).

The time set in the timer T2 is a time it takes the paddles 70*f* to make one rotation and return to the retreating position. On confirmation of the expiration of the timer T2 at step S18, the solenoid SL1 is turned off at step S19, and the timer T2 is reset at step S20. By the turning-off of the solenoid SL1, the paddles 70*f* are stopped in the retreating position.

One of the subject matters of the third embodiment is that the trailing portion of a sheet slips between the transport roller 80 and the guide roller 62 for correction of possible skew of the sheet. In the third embodiment, in order to make a time for slipping of the trailing portion, the paddles 70*f* are moved with a slight time lag. However, other various ways are possible to make the trailing portion of a sheet slip between the transport roller 80 and the guide roller 62. For example, it is possible to provide collars to the wheels of the guide roller 62 or to finish the rings 80*f* of the transport roller 80 and the wheels of the guide roller 62 to have surfaces with a low coefficient of friction. Also, as mentioned, it is possible to provide curved plates to the transport roller 80 instead of the collars 80*b*.

A reversing unit which is structured upside down from the reversing unit of the third embodiment is possible. In this reversing unit, since the weight of a sheet works as the feed-back force to the transport roller 80, the reversing rollers 65 and 66 are not always necessary.

The above-described embodiments are sheet reversing units of a type wherein a take-in path, a reversing path and a take-out path are joined into a shape of a T. However, the present invention is applicable to a sheet reversing unit wherein a take-in path, a reversing path and a take-out path are joined into a shape of a Y. Also, it is possible to arrange a take-in path and a take-out path laterally and vertically, respectively.

Although the present invention has been described in connection with the preferred embodiments above, it is to be noted that various changes and modifications are possible to those who are skilled in the art. Such changes and modifications are to be understood as being within the scope of the present invention.

What is claimed is:

1. A sheet reversing apparatus comprising:

a take-in path;

a reversing path which extends from the take-in path in a substantially same direction;

a take-out path which extends from a junction of the take-in path and the reversing path in a substantially perpendicular direction to the extending direction of the reversing path;

a transport roller which is disposed at the junction of the take-in path, the reversing path and the take-out path, the roller transporting a sheet from the take-in path to the reversing path and from the reversing path to the take-out path;

a first reversing roller which is disposed in an entrance portion of the reversing path, the first reversing roller being driven to rotate in a feed-back direction toward the take-in path at all times;

a second reversing roller which is capable of coming into contact with and moving away from the first reversing roller, the second reversing roller being freely rotatable; and a lever which keeps the second reversing roller away from the first reversing roller until a trailing edge of a sheet comes out of the take-in path and makes the second reversing roller come into contact with the first reversing roller when the trailing edge of the sheet comes out of the take-in path.

2. A sheet reversing apparatus as claimed in claim 1, wherein:

the lever is held such that an end of the lever is usually located in the take-in path while being capable of retreating from the take-in path;

while the end of the lever is located in the take-in path, the lever keeps the second reversing roller in contact with the first reversing roller; and while a sheet fed in the take-in path pushes the end of the lever out of the take-in path, the lever keeps the second reversing roller away from the first reversing roller.

3. A sheet reversing apparatus as claimed in claim 2, wherein the lever is urged by a spring such that the end of the lever is usually located in the take-in path.

4. A sheet reversing apparatus as claimed in claim 1, wherein the transport roller has on a circumference a plurality of paddles which catch the trailing edge of a sheet and carry the edge toward the take-out path.

5. A sheet reversing apparatus comprising:

a take-in path;

a reversing path which extends from the take-in path in a substantially same direction;

a take-out path which extends from a junction of the take-in path and the reversing path in a substantially perpendicular direction to the extending direction of the reversing path;

a transport roller which is disposed at the junction of the take-in path, the reversing path and the take-out path, the roller transporting a sheet from the take-in path to the reversing path and from the reversing path to the take-out path;

a guide roller which is disposed at the junction of the take-in path and the reversing path, the guide roller transporting a sheet in cooperation with the transport roller;

a first reversing roller which is disposed in an entrance portion of the reversing path, the first reversing roller being driven to rotate in a feed-back direction toward the take-in path at all times;

a second reversing roller which is capable of coming into contact with and moving away from the first reversing roller, the second reversing roller being freely rotatable; and a lever which keeps the second reversing roller away from the first reversing roller until a trailing edge of a sheet passes through a nipping portion of the transport roller and the guide roller and makes the second reversing roller come into contact with the first reversing roller with a time lag after the trailing edge of the sheet passes through the nipping portion.

6. A sheet reversing apparatus as claimed in claim 5, wherein:

the lever is held such that an end of the lever is usually located in the take-in path while being capable of retreating from the take-in path;

while the end of the lever is located in the take-in path, the lever keeps the second reversing roller in contact with the first reversing roller; and while a sheet fed in the take-in path pushes the end of the lever out of the take-in path, the lever keeps the second reversing roller away from the first reversing roller.

7. A sheet reversing apparatus as claimed in claim 6, wherein the lever is urged by a spring such that the end of the lever is usually located in the take-in path.

8. A sheet reversing apparatus as claimed in claim 5, wherein the transport roller has on a circumference a plurality of paddles which catch the trailing edge of a sheet and carry the edge toward the take-out path.

9. A sheet reversing apparatus comprising:

a take-in path;

a reversing path which extends from the take-in path in a substantially same direction;

a take-out path which extends from a junction of the take-in path and the reversing path in a substantially perpendicular direction to the extending direction of the reversing path;

a first reversing roller which is disposed in an entrance portion of the reversing path, the first reversing roller being driven to rotate around an axis in a feed-back direction toward the take-in path at all times; and a second reversing roller which is capable of coming into contact with and moving away from the first reversing roller, the second reversing roller being freely rotatable around an axis which is provided farther inside the reversing path than the axis of the first reversing roller;

wherein, a sheet is fed from the take-in path to the reversing path, and when a trailing edge of the sheet comes out of the take-in path, the sheet is fed back from the reversing path toward the take-out path.

10. A sheet reversing apparatus as claimed in claim 9, further comprising a guide member which extends from the take-in path to the reversing path to support a sheet, the guide member curving at the junction of the take-in path and the reversing path in an opposite direction to the extending direction of the take-out path.

11. A sheet reversing apparatus as claimed in claim 9, wherein the second reversing roller is away from the first reversing roller until a trailing edge of a sheet which is being fed to the reversing path comes out of the take-in path, and comes into contact with the first reversing roller after the trailing edge of the sheet comes out of the take-in path.

12. A sheet reversing apparatus as claimed in claim 9, wherein said first reversing roller is disposed on the same side as the take-out path while said second reversing roller is disposed on the opposite side of the take-out path.

13. A sheet reversing path comprising:

a take-in path;

a reversing path which extends from the take-in path in a substantially same direction;

a take-out path which extends from a junction of the take-in path and the reversing path in a substantially perpendicular direction to the extending direction of the reversing path;

a transport roller which is disposed at the junction of the take-in path, the reversing path and the take-out path, the transport roller being driven to rotate in one direction at all times;

a first guide roller for transporting a sheet from the take-in path to the reversing path, the first guide roller being in contact with and driven by the transport roller;

a second guide roller for transporting a sheet from the reversing path to the take-out path, the second guide roller being in contact with and driven by the transport roller;

a paddle roller which is provided coaxially with the transport roller, the paddle roller having a paddle projecting over a circumference of the transport roller;

a clutch mechanism which connects the paddle roller with the transport roller to rotate the paddle roller and disconnects the paddle roller from the transport roller to stop the rotation of the paddle roller;

a sensor which detects that a trailing edge of a sheet passes between the transport roller and the first guide roller; and a controller which actuates the clutch mechanism to rotate the paddle roller a specified time after the sensor detects the trailing edge of the sheet.

14. A sheet reversing apparatus comprising:

a first path;

a pair of transport rollers provided in the first path to transport a sheet in a first direction;

a pair of reversing rollers provided in the first path to transport the sheet in a second direction opposite to the first direction;

a second path which diverges from the first path to guide the sheet transported in the second direction; and a lever which is pivotally provided on an axis disposed downstream of the reversing rollers with respect to the first direction, an end of the lever advancing in the first path when one of the reversing rollers comes into contact with the other reversing roller.

15. A sheet reversing apparatus as claimed in claim 14, wherein the lever is urged by a spring such that the end of the lever is usually located in the first path.

16. A sheet reversing apparatus as claimed in claim 14, wherein:

said transport rollers are disposed at a junction of the first path and the second path; and one of the transport rollers has on a circumference a plurality of paddles which catch a trailing edge of a sheet and carry the edge toward the second path.

17. A sheet reversing apparatus comprising:

a take-in path;

a reversing path which extends from the take-in path;

a take-out path which extends from a junction of the take-in path and the reversing path;

a transport roller which is disposed at the junction of the take-in path, the reversing path and the take-out path, the roller transporting a sheet from the take-in path to the reversing path and from the reversing path to the take-out path; and a pair of rollers which are disposed in the reversing path and driven to rotate in a feed-back direction toward the take-in path, a tangential line on a contact point of the rollers being on a slant to an opposite side of the take-out path.

18. A sheet reversing apparatus as claimed in claim 17, wherein:

the reversing path extends from the take-in path in a substantially same direction; and the take-out path extends from the junction in a substantially perpendicular direction to the extending direction of the reversing path.

* * * * *